US009528205B2

(12) United States Patent
Thompson et al.

(10) Patent No.: US 9,528,205 B2
(45) Date of Patent: Dec. 27, 2016

(54) BRAIDING MECHANISM AND METHODS OF USE

(71) Applicant: SEQUENT MEDICAL, INC., Aliso Viejo, CA (US)

(72) Inventors: James M Thompson, Lake Forest, CA (US); Brian J Cox, Laguna Niguel, CA (US); Robert Rosenbluth, Laguna Niguel, CA (US); Philippe Marchand, Lake Forest, CA (US); John Nolting, Poway, CA (US); Darrin J Kent, Murrieta, CA (US); Tan Q Dinh, Santa Ana, CA (US); Hung P Tran, Westminster, CA (US); James A Milburn, Irvine, CA (US)

(73) Assignee: Sequent Medical, Inc, Aliso Viejo, CA (US)

( * ) Notice: Subject to any disclaimer, the term of this patent is extended or adjusted under 35 U.S.C. 154(b) by 107 days.

(21) Appl. No.: 14/329,582

(22) Filed: Jul. 11, 2014

(65) Prior Publication Data

US 2014/0318354 A1 Oct. 30, 2014

Related U.S. Application Data

(63) Continuation of application No. 13/608,882, filed on Sep. 10, 2012, now Pat. No. 8,826,791, which is a (Continued)

(51) Int. Cl.
*D04C 3/48* (2006.01)
*D04C 3/40* (2006.01)

(Continued)

(52) U.S. Cl.
CPC . *D04C 3/48* (2013.01); *D04C 1/00* (2013.01); *D04C 1/02* (2013.01); *D04C 1/06* (2013.01);

(Continued)

(58) Field of Classification Search
CPC ..... D04C 1/06; D04C 3/40; D04C 3/42; D04C 3/48
See application file for complete search history.

(56) References Cited

U.S. PATENT DOCUMENTS 1,059,523 A 4/1913 Brondel
1,356,570 A 10/1920 Tupney (Continued)

FOREIGN PATENT DOCUMENTS

CN 201581220 9/2010
EP 0088913 9/1983

(Continued)

OTHER PUBLICATIONS

Bicking, A.M., Explorations in Fancy Braid Creation Through the Use of Industrial Machinery, (Bicking UNC thesis 2011 pdf).

(Continued)

*Primary Examiner* — Shaun R Hurley
(74) *Attorney, Agent, or Firm* — O'Melveny & Myers LLP

(57) ABSTRACT

A braiding machine and methods of braiding are described. The braiding machine includes first and second annular members having inclined surfaces, the second annular member being concentric with the first annular member. The inclined surfaces are inclined at a non-zero angle formed between an axis of the outer ring and a horizontal axis that lies perpendicular to the longitudinal axis of the mandrel. Each of the annular members has a plurality of tubular guide wires slideably mounted thereon and a plurality of wires extend from the mandrel through each of the tubular wire guides. One of the first and second annular members rotates circumferentially relative to the other. The first plurality of tubular wire guides slides radially inward so as to align with the second annular member, and the second plurality of (Continued)

tubular wire guides slides radially outward so as to align with the first annular member.

26 Claims, 35 Drawing Sheets

Related U.S. Application Data continuation-in-part of application No. 13/570,499, filed on Aug. 9, 2012, now Pat. No. 8,430,012, which is a continuation of application No. 13/275,264, filed on Oct. 17, 2011, now Pat. No. 8,261,648.

(51) Int. Cl.

| | |
|---|---|
| ***D04C 1/00*** | (2006.01) |
| ***D04C 3/42*** | (2006.01) |
| ***D04C 1/12*** | (2006.01) |
| ***D04C 1/02*** | (2006.01) |
| ***D04C 1/06*** | (2006.01) |

(52) U.S. Cl.
CPC . *D04C 1/12* (2013.01); *D04C 3/40* (2013.01); *D04C 3/42* (2013.01); *D10B 2509/04* (2013.01)

(56) References Cited

U.S. PATENT DOCUMENTS

| | | | |
|---|---|---|---|
| 1,660,049 | A | 2/1928 | Riva |
| 1,830,196 | A | 11/1931 | Faure-Roux |
| 1,854,168 | A | 4/1932 | Beilhartz |
| 1,913,292 | A | 6/1933 | Schweiter |
| 1,981,377 | A | 11/1934 | Standish |
| 2,672,071 | A | 3/1954 | Marogg |
| 3,783,736 | A | 1/1974 | Richardson |
| 4,034,642 | A | 7/1977 | Iannucci |
| 4,130,046 | A | 12/1978 | Sokol |
| 4,202,718 | A | 5/1980 | Mizutani |
| 4,372,191 | A | 2/1983 | Iannucci |
| 4,535,674 | A | 8/1985 | Bull et al. |
| 4,567,917 | A | 2/1986 | Millard |
| 4,621,560 | A | 11/1986 | Brown |
| 4,729,278 | A | 3/1988 | Graeff |
| 4,753,149 | A | 6/1988 | Celani |
| 4,753,150 | A | 6/1988 | Brown |
| 4,922,798 | A | 5/1990 | Ivsan et al. |
| 4,934,240 | A | 6/1990 | Culp, Sr. |
| 5,071,407 | A | 12/1991 | Termin et al. |
| 5,099,744 | A | 3/1992 | Hurst |
| 5,122,136 | A | 6/1992 | Guglielmi et al. |
| 5,176,062 | A | 1/1993 | Maillefer |
| 5,257,571 | A | 11/1993 | Richardson |
| 5,301,596 | A | 4/1994 | Huey, Jr. |
| 5,361,674 | A | 11/1994 | Akiyama |
| 5,398,586 | A | 3/1995 | Akiyama et al. |
| 5,419,231 | A | 5/1995 | Earle, III |
| 5,476,027 | A | 12/1995 | Uchida |
| 5,718,159 | A | 2/1998 | Thompson |
| 5,787,784 | A | 8/1998 | Scherzinger |
| 5,913,959 | A | 6/1999 | Klein |
| 5,944,738 | A | 8/1999 | Amplatz et al. |
| 5,974,938 | A | 11/1999 | Lloyd |
| 6,439,099 | B1 | 8/2002 | Carlson et al. |
| 6,679,152 | B1 | 1/2004 | Head |
| 7,083,644 | B1 | 8/2006 | Moroni |
| 7,093,527 | B2 | 8/2006 | Rapaport |
| 7,165,945 | B2 | 1/2007 | Kovalsky |
| 7,270,043 | B2 | 9/2007 | Presz, Jr. |
| 7,275,471 | B2 | 10/2007 | Nishri |
| 7,311,031 | B2 | 12/2007 | McCullagh |
| 7,500,345 | B2 | 3/2009 | Kish |
| 8,261,648 | B1 | 9/2012 | Marchand et al. |
| 8,430,012 | B1 | 4/2013 | Marchand et al. |
| 8,534,176 | B2 | 9/2013 | Giszter et al. |
| 9,200,388 | B1 | 12/2015 | Gallmeyer et al. |
| 2002/0065552 | A1 | 5/2002 | Jayaraman et al. |
| 2003/0069629 | A1 | 4/2003 | Jadhav et al. |
| 2004/0024416 | A1 | 2/2004 | Yodfat |
| 2004/0073300 | A1 | 4/2004 | Chouinard |
| 2007/0225760 | A1 | 9/2007 | Moszner |
| 2008/0104827 | A1 | 5/2008 | Kish |
| 2009/0099643 | A1 | 4/2009 | Hyodoh et al. |
| 2009/0198315 | A1 | 8/2009 | Boudjemline |
| 2010/0043959 | A1 | 2/2010 | Zhou |
| 2010/0191319 | A1 | 7/2010 | Lilburn |
| 2011/0277618 | A1* | 11/2011 | Giszter ..... D04C 3/42 87/8 |
| 2013/0092012 | A1 | 4/2013 | Marchand et al. |
| 2013/0092013 | A1 | 4/2013 | Thompson et al. |
| 2013/0233160 | A1 | 9/2013 | Marchand et al. |
| 2013/0239790 | A1 | 9/2013 | Thompson et al. |

FOREIGN PATENT DOCUMENTS

| | | |
|---|---|---|
| EP | 0341434 | 11/1989 |
| EP | 1248872 B1 | 10/2010 |
| FR | 2333169 | 6/1977 |
| GB | 638 | 0/1748 |
| JP | 52141092 | 11/1977 |
| JP | S57117660 | 7/1982 |
| JP | S61138760 | 6/1986 |
| JP | H4-47415 | 4/1992 |
| JP | H04108148 A | 4/1992 |
| JP | P3221490 | 8/2001 |
| RU | 2135659 C1 | 8/1999 |
| WO | WO 2013/058889 | 4/2013 |

OTHER PUBLICATIONS

Brunnschweiler, D., Braids and Braiding, College of Technology, Manchester University, Available online: Jan. 7, 2009.

Janssen, H., Plaited Soutache (no date) @ http://www.cs.arizona.edu/pattern/weaving/articles/jh_plait.pdf.

Noer, F., Braiders Rock Solid Equipment (May/Jun. 2011) @ http://www.compositewire.com/wireharness.php.

Sanjay, P., TTL733: Selected Topics in Fabric Manufacture, A Term Paper on "Braiding," Department of Textile Technology, Indian Institute of Technology, Delhi (2008).

Wulfhorst, B. et al., *Textile Technology*, Hanser Publishers, Munich, Germany (2006).

* cited by examiner

BRAIDING MECHANISM AND METHODS OF USE

CROSS REFERENCES TO RELATED APPLICATIONS

This is a continuation of U.S. application Ser. No. 13/608,882, filed Sep. 10, 2012, which is a continuation-in-part of U.S. application Ser. No. 13/570,499, filed Aug. 9, 2012, now issued as U.S. Pat. No. 8,430,012, which is a continuation of U.S. application Ser. No. 13/275,264, filed Oct. 17, 2011, now issued as U.S. Pat. No. 8,261,648, the disclosures of all of which are hereby incorporated by reference in their entirety for all purposes.

FIELD OF THE INVENTION

The invention relates to an apparatus and methods for making a tubular braid comprising a plurality of filaments, particularly small diameter wires.

BACKGROUND OF THE INVENTION

Braiding machines have long been used in industry, for example, to braid metallic wire into electrical or electronic cable as a protective armor or into hydraulic hose and cordage as a load bearing structure or into rope, either metallic or non-metallic.

The two main kinds of braiding machines presently used are maypole-type braiding machines and internal cam rotary-type braiding machines. The maypole-type machine uses a plurality of spool carriers to carry filament bobbins in serpentine-like paths about a track plate. The track plate consists of two separate paths: each path 180 degrees out of phase from the other. One path moves clockwise, while the other path moves counter clockwise. Horn gears or notched rotors on the deck create the serpentine path. Half the carriers travel in the first path around the braiding point following one serpentine path created by the horn gears while the other half of the carriers travel in the second path, in the opposite direction around the braiding point. As the two sets of carriers travel in opposite directions around the braiding point, each set crosses the path of the other and the strands leaving the filament bobbins are interwoven as they converge to the braiding point. The speed of these machines is limited by the inertia of the carriers and/or changes in tension on the filaments resulting from the continuously changing radial movement towards and away from the point of braid formation.

These types of braiding machines, however, are generally limited to production of braids using lower filament count and/or generally large filaments. Typical braid structures of small filaments are 72, 96 and 144 in a one-over, one-under braid pattern. These same machines, generally of the maypole variety with horn gears and carriers, may also be used to produce 144, 192 or 288 braids of two-over, two-under construction. Very large "Megabraiders" have been manufactured with up to 800 carriers that will produce high filament count braids. See http://www.braider.com/About/Megabraiders.aspx. These Megabraiders, however, are generally used for large structures and are not suitable for most medical applications that require construction with fine wires that have low tensile strength.

The internal cam rotary type braiding machine, known as the Wardwell Rapid Braider, uses a high-speed braiding process. This type of machine uses a plurality of lower carrier members and a plurality of upper carrier members, which travel past each other in continuous circular paths centered about the braid axis, going in opposite directions. As the upper and lower carriers travel past each other in opposite directions, strands from bobbins on the lower carriers are intertwined with strands from bobbins on the upper carriers. Deflectors are used to lift strands of the lower carriers up and over strands from the upper carriers, so that only the strands of the lower carriers are alternately passed over and under strands of the upper carriers to create the interwoven pattern. The Wardwell Braider, however, becomes unreliable when trying to braid strands or filaments of material, particularly very fine wire materials, having extremely small diameters. The rotary technique used therein produces so much tension on the very small diameter materials, particularly at one stage of the braiding process, that such extremely fine filaments tend to break, requiring that the machine be stopped.

Thus, it would be desirable to provide a braiding machine and process capable of manufacturing high wire count tubular braids of small diameter filaments without breakage.

SUMMARY OF THE INVENTION

The braiding apparatus described herein provides improved means of manufacturing high wire-count (also described as high picks per inch or PPI) tubular braids of small diameter filaments, and is particularly useful for the production of fine wire metallic alloy (e.g. nitinol, cobalt-chrome and platinum-tungsten) for medical applications.

Some embodiments of a braiding machine include a disc defining a plane and a circumferential edge, a mandrel extending from a center of the disc and generally perpendicular to the plane of the disc, a plurality of catch mechanisms positioned circumferentially around the edge of the disc, and a plurality of actuators adapted to move the plurality of catch mechanisms in a substantially radial direction relative to the circumferential edge of the disc. The mandrel is adapted to hold a plurality of filaments extending radially from the mandrel toward the circumferential edge of the disc and each catch mechanism extends toward the circumferential edge of the disc and is adapted to engage a filament. The point at which each filament engages the circumferential edge of the disc is separated by a distance d from the points at which each immediately adjacent filament engages the circumferential edge of the disc. The disc and the plurality of catch mechanisms are configured to move relative to one another to rotate a first subset of the filaments relative to a second subset of filaments to interweave the filaments. The disc may be adapted to rotate around an axis perpendicular to the plane of the disc, for example, in discrete steps of distance 2d. Alternatively, the plurality of catch mechanisms may be adapted to rotate around an axis perpendicular to the plane of the disc, for example, in discrete steps of a distance 2d.

In some embodiments, the braiding machine may be loaded with a plurality of filaments extending radially from the mandrel towards the circumferential edge of the disc. Here, each of the plurality of filaments contacts the circumferential edge of the disc at a point of engagement which is spaced apart a discrete distance from adjacent points of engagement. In some embodiments, the filaments may be wires. For example, the wires may be a plurality of fine wires having a diameter of between about ½ mil to 5 mils.

In some embodiments, the circular disc may have a plurality of notches radially spaced apart around the circumferential edge for holding individual filaments against the circumferential edge. For example, in some embodiments, the circumferential edge of the disc may have between about 100-1500 notches, alternatively between about 100-1000 notches, alternatively between about 100-500 notches, alternatively between about 100-300 notches, alternatively 108, 144, 288, 360, or 800 notches. Some embodiments may further include a filament stabilizing elements, such as a cylindrical drum positioned on the second side of the disc and extending generally perpendicular to the plane of the disc. The drum may have a plurality of grooves extending longitudinally around the circumference of the drum in which individual filaments each rest with a different groove. In some embodiments, individual tensioning elements may extend from each of the plurality of filaments. The tensioning elements may each be configured to apply between about 2-20 grams of force to a filament. In sonic embodiments, the tensioning elements may each be configured to apply a force to a filament that is inversely proportional to the filament diameter. For wire sizes between 0.00075 to 0.0015 inches, the tensioning element may apply a force that is governed by the following equation:

$F_T=-8000D_w+16$ where $D_w$ is the wire diameter in inches and $F_T$ is the force in grams In some embodiments, the actuator may be coupled to a plurality of catch mechanisms and configured to collectively move the plurality of coupled catch mechanisms. In some embodiments, the catch mechanisms are hooks, such as double headed hooks. In other embodiments, the catch mechanisms, and actuators may be angled relative to the plane of the disc.

Some embodiments of a braiding machine include a disc defining a plane and a circumferential edge, a mandrel extending from a center of the disc and generally perpendicular to the plane of the disc, a plurality of filaments extending from the mandrel toward the circumferential edge of the disc, and a plurality of catch mechanisms positioned circumferentially around the edge of the disc. The mandrel holds the filaments such that each filament contacts the circumferential edge of the disc at a point of engagement which is spaced apart a discrete distance from adjacent points of engagement. Each catch mechanism extends toward the circumferential edge of the disc and is adapted to engage a filament and pull the filament away from the circumferential edge of the disc in a generally radial direction.

In some embodiments, the points of engagements on the circumferential edge of the disc comprise a plurality of notches radially spaced apart around the circumferential edge. The drum may have a plurality of grooves extending longitudinally around the circumference. For example, in some embodiments, the drum may have between about 100-1500 grooves between about 100-1500 grooves, alternatively between about 100-1000 grooves, alternatively between about 100-500 grooves, alternatively between about 100-300 grooves, alternatively 108, 144, 288, 360, or 800 grooves. In some embodiments, each of the plurality of filaments rests within a different notch.

In some embodiments, the plurality of catch mechanisms is coupled to a plurality of actuators that are actuated to pull the catch mechanisms away from the circumferential edge of the disc in a generally radial direction. Each actuator may be coupled to a single catch mechanism. Alternatively, each actuator may be coupled to a plurality of catch mechanisms and configured to collectively move the plurality of coupled catch mechanisms. In some embodiments, the catch mechanisms each comprise a hook, such as a double headed hook, in other embodiments, the catch mechanisms, and actuators may be angled relative to the plane of the disc. In sonic embodiments, the angulation of the actuators relative to the plane of the disc may be between about 15° and 60°.

In some embodiments, the disc and the plurality of catch mechanisms are configured to move relative to one another to rotate a first subset of the filaments relative to a second subset of filaments to interweave the filaments. The disc may be adapted to rotate around an axis perpendicular to the plane of the disc, for example, in discrete steps of a distance 2d. Alternatively, the plurality of catch mechanisms may be adapted to rotate around an axis perpendicular to the plane of the disc, for example, in discrete steps of a distance 2d.

Some embodiments of a braiding machine include a computer program embodied in a non-transitory computer readable medium, that when executing on one or more computers provides instructions to engage a subset of the plurality of filaments and to move the disc and the plurality of catch mechanisms relative to one another in discrete step.

In some embodiments, a motor configured to rotate the plurality of catch mechanisms around an axis perpendicular to the plane of the disc is provided. Alternatively, a motor configured to rotate the plurality of catch mechanisms around an axis perpendicular to the plane of the disc may be provided.

The plurality of catch mechanism may comprise a plurality of hooks. Each actuator may be coupled to a plurality of catch mechanisms. Alternatively, each actuator may be coupled to a single catch mechanism. In some embodiments, a first subset of actuators may be individually coupled to a plurality of single catch mechanisms and a second subset of actuators may each be coupled to a plurality of catch mechanisms.

In some embodiments, the computer program may include instructions for moving the disc and plurality of catch mechanisms relative to one another to create a one over, one under braid pattern. Alternatively, the computer program may include instructions for moving the disc and plurality of catch mechanisms relative to one another to create a one over, three under braid pattern. Other computer programs may include instructions for sequentially moving a subset of the plurality of catch mechanisms and rotating the disc and catch mechanisms relative to one another to create a one-over, one-under (diamond) braid pattern.

Some embodiments of a braiding machine include a disc defining a plane and a circumferential edge, a mandrel extending from a center of the disc and generally perpendicular to the plane of the disc which is adapted to hold a plurality of filaments extending radially from the mandrel toward the circumferential edge of the disc. A means for engaging each filament at a point of engagement along the circumferential edge of the disc at a plurality of discrete radial locations a distance d from immediately adjacent points of engagement and a means for capturing a subset of the filaments are also provided. The means for capturing a subset of the filaments is positioned circumferentially around the edge of the disc and extends toward the circumferential edge of the disc. A means is further provided for moving the captured subset of filaments away from the circumferential edge of the disc in a generally radial direction. A means for rotating the disc and captured subset of filaments relative to one another is also provided.

In some embodiments, the means for rotating the disc and captured subset of filaments relative to one another comprises a means for rotating the disc a discrete distance. Alternatively, the means for rotating the disc and captured subset of filaments relative to one another may comprise a means for rotating the captured filaments a discrete distance.

In some embodiments the means for capturing a subset of filaments may comprise a plurality of hooks.

Also described are methods for forming a tubular braid. The methods comprise steps of providing a braiding mechanism comprising a disc defining a plane and a circumferential edge, a mandrel extending from a center of the disc and generally perpendicular to the plane of the disc, and a plurality of actuators positioned circumferentially around the edge of the disc. A plurality of filaments are a loaded on the mandrel such that each filament extends radially toward the circumferential edge of the disc and each filament contacts the disc at a point of engagement on the circumferential edge, which is spaced apart a discrete distance from adjacent points of engagement. A first subset of the plurality of filaments is engaged by the actuators and the plurality of actuators is operated to move the engaged filaments in a generally radial direction to a position beyond the circumferential edge of the disc. The disc is then rotated a first direction by a circumferential distance, thereby rotating a second subset of filaments a discrete distance and crossing the filaments of the first subset over the filaments of the second subset. The actuators are operated again to move the first subset of filaments to a radial position on the circumferential edge of the disc, wherein each filament in the first subset is released to engage the circumferential edge of the disc at a circumferential distance from its previous point of engagement.

In some embodiments, the second subset of filaments is engaged and the plurality of actuators is operated to move the engaged filaments in a generally radial direction to a position beyond the circumferential edge of the disc. The disc is then rotated in a second, opposite direction by a circumferential distance, thereby rotating the first subset of filaments a discrete distance and crossing the filaments of the second subset over the filaments of the first subset. The actuators are operated a second time to move the second subset of filaments to a radial position on the circumferential edge of the disc, wherein each filament in the second subset engages the circumferential edge of the disc at a circumferential distance from its previous point of engagement.

In some embodiments, these steps may be repeated. Alternatively, a third subset of the plurality of filaments may be engaged and the plurality of actuators is operated to move the engaged filaments in a generally radial direction to a position beyond the circumferential edge of the disc. The disc may then be rotated in a first direction by a circumferential distance, thereby rotating a fourth subset of filaments a discrete distance and crossing the filaments of the third subset over the filaments of the fourth subset. The actuators are operated a second time to move the third subset of filaments to a radial position on the circumferential edge of the disc and the fourth set of filaments is then engaged. The actuators are operated again to move the engaged filaments in a generally radial direction to a position beyond the circumferential edge of the disc and the disc is then rotated in a second, opposite direction by a circumferential distance, thereby rotating the third subset of filaments a discrete distance and crossing the filaments of the fourth subset over the filaments of the third subset. The actuators are operated again to move the fourth subset of filaments to a radial position on the circumferential edge of the disc.

Some embodiments of a method for forming a tubular braid include providing a braiding mechanism comprising a disc defining a plane and a circumferential edge having a plurality of notches, each notch separated from the next adjacent notch by distance d, a mandrel extending from a center of the disc and generally perpendicular to the plane of the disc, and a plurality of catch mechanisms positioned circumferentially around the edge of the disc, each catch mechanism extending toward the circumferential edge of the disc. The mandrel of the braiding mechanism is loaded with a plurality of filaments extending toward the circumferential edge of the disc wherein each filament rests within a different notch on the circumferential edge. To make a one over one under braid, the plurality of catch mechanisms is operated to engage every other filament and pull the engaged filaments away from the circumferential edge of the disc in a generally radial direction, thereby emptying every other notch. The disc is then rotated in a first direction by a circumferential distance and the plurality of catch mechanisms are operated to release each engaged filament radially toward the circumferential edge of the disc, wherein each filament is placed in an empty notch located a circumferential distance 2d from the notch formerly occupied. To make other braid patterns, such as two over, one under, the plurality of catch mechanisms are operated to engage every third or higher filament, as will be understood by those skilled in the art.

In some embodiments, the disc is rotated by a circumferential distance and the plurality of catch mechanisms are then operated to engage every other filament and pull the engaged filaments in a generally radial direction to a position beyond the circumferential edge of the disc. The disc is then rotated in a second, opposite direction by a circumferential distance; and the plurality of catch mechanisms are operated to release each engaged filament radially toward the circumferential edge of the disc, wherein each filament is placed in an empty notch located a circumferential distance from the notch formerly occupied. In some embodiments, the disc is rotated by a circumferential distance 2d in the first direction. In some embodiment, the disc may further be rotated by a circumferential distance 2d in the second direction.

Some embodiments of a tubular braid include a braid made by a process including temporarily affixing a plurality of filaments on a distal end of a mandrel extending perpendicularly from the center of a disc such that each filament extends radially from the mandrel towards the circumferential edge of the disc and engage the circumferential edge of the disc at independent points of engagement separated by a distance d from adjacent points of engagement. The first subset of filaments is engaged and a plurality of actuators is operated to move the engaged filaments in a generally radial direction to a radial position beyond the circumferential edge of the disc. The disc is rotated in a first direction by a circumferential distance, thereby rotating a second subset of filaments still engaging disc a discrete distance and crossing the filaments of the first subset over the filaments of the second subset. The plurality of actuators is operated to move the first subset of filaments to a radial position on the circumferential edge of the disc, which is a circumferential distance from its previous point of engagement. The second subset of filaments is engaged and the actuators are operated to move the engaged filaments in a generally radial direction to a radial position beyond the circumferential edge of the disc. The disc is rotated disc in a second, opposite direction by a circumferential distance, thereby rotating the first subset of filaments a discrete distance and crossing the filaments of the second subset over the filaments of the first subset. The actuators are then operated to move the second subset of filaments to a radial position on the circumferential edge of the disc, wherein each filament in the second subset engages the circumferential edge of the disc at a circumferential distance from its previous point of engagement.

In some embodiments the braid formed has a one-over, one-under (diamond) braid pattern. Alternatively, the braid formed may have a one-over, three-under braid pattern. Alternatively, the braid formed may have a two-over, two-under braid pattern.

In another embodiment, the invention includes a mechanism for braiding. The braiding mechanism includes a circular array of filament guiding members defining a plane, a mandrel extending from a center of the circular array of filament guiding members and generally perpendicular to the plane of the circular array of filament guiding members defining an axis, a plurality of filaments extending from the mandrel in a radial array, and a plurality of actuator mechanisms disposed operably about the circular array of filament guiding members. The plurality of actuator mechanisms may be positioned circumferentially about the circular array, alternatively positioned above the circular array, alternatively below the circular array, alternatively within the circular array. Each actuator mechanism is adapted to engage one or more filaments and move the one or more filaments away from the mandrel in a generally radial direction. The mechanism further includes a rotating mechanism configured to rotate one or more filaments about the axis of the mandrel. The actuator mechanisms and rotating mechanism are configured to move each of the one or more filaments about the mandrel axis in a path comprising a series of arcs and radial movements. The path may be a notched or gear tooth-like path.

In another embodiment, the invention includes a method for forming a tubular braid. A braiding mechanism is provided. The braiding mechanism includes a circular array of filament guiding members, a mandrel, a plurality of actuators, and a rotating mechanism. The circular array of filament guiding members defines a plane and a circumferential edge. The mandrel extends from a center of the circular array of filament guiding members and is generally perpendicular to the plane of the circular array of filament guiding members. The mandrel defines an axis and is adapted to carry one or more filaments extending from the mandrel to the circular array of filament guiding members. The plurality of actuators is disposed operably about the circular array of filament guiding members. The rotating mechanism is adapted to rotate the one or more filaments. The plurality of actuator mechanisms may be positioned circumferentially about the circular array, alternatively positioned above the circular array, alternatively below the circular array, alternatively within the circular array. A plurality of filaments is then loaded onto the mandrel, each of the plurality of filaments extending radially toward the circumferential edge of the circular array of filament guiding members, forming a radial array of filament engagement points. The plurality of actuators and the rotating mechanism arc then operated to move the filaments about the mandrel axis in a path comprising a series of discrete arcs and radial movements for each filament.

In another embodiment, the invention includes a braiding machine. The braiding machine includes first and second annular members, a mandrel, first and second pluralities of tubular wire guides, and a plurality of wires extending from the mandrel. The first annular member has an inner diameter and defines a circle that defines a plane. The second annular member is concentric with the first annular member and has an outer diameter that is less than the inner diameter of the first annular member. The mandrel extends perpendicularly to the plane of the first annular member and intersects the plane of the first annular member substantially at the center of the circle defined by the first annular member. The first plurality of tubular wire guides is slideably mounted on the first annular member and extends perpendicularly to the plane of the first annular member, the tubular wire guides being mounted around the circumference of the first annular member with each tubular wire guide space a distance 2d from the next adjacent tubular wire guide of the first annular member. The second plurality of tubular wire guides is slideably mounted on the second annular member and extends perpendicularly to the plane of the second annular member, the tubular wire guides being mounted around the circumference of the second annular member with each tubular wire guide space a distance 2d from the next adjacent tubular wire guide of the second annular member and d from each adjacent wire guide of the first annular member. The plurality of wires extends from the mandrel and each wire is received within one of the tubular wire guides. One of the first and second annular members rotates circumferentially relative to the other of the first and second annular members. The first plurality of tubular wire guides slides radially inward so as to align with the second annular member. Additionally, the second plurality of tubular wire guides slides radially outward so as to align with the first annular member.

In another embodiment, the invention includes a method of braiding. A machine is provided that includes first and second annular members, a mandrel, first and second pluralities of tubular wire guides, and a plurality of wires. The first annular member has an inner diameter and defines a circle that defines a plane. The second annular member is concentric with the first annular member and has an outer diameter that is less than the inner diameter of the first annular member. The mandrel extends perpendicularly to the plane of the first annular member and intersects the plane of the first annular member substantially at the center of the circle defined by the first annular member. The first plurality of tubular wire guides is slideably mounted on the first annular member and extends perpendicularly to the plane of the first annular member, the tubular wire guides being mounted around the circumference of the first annular member with each tubular wire guide space a distance 2d from the next adjacent tubular wire guide of the first annular member. The second plurality of tubular wire guides is slideably mounted on the second annular member and extends perpendicularly to the plane of the second annular member, the tubular wire guides being mounted around the circumference of the second annular member with each tubular wire guide space a distance 2d from the next adjacent tubular wire guide of the second annular member and d from each adjacent wire guide of the first annular member. The plurality of wires extends from the mandrel and each wire is received within one of the tubular wire guides. The first annular member is rotated circumferentially relative to the second annular member in a first direction. The first plurality of tubular wire guides are slid or translated radially inward so as to align with the second annular member. The second plurality of tubular wire guides are slid or translated radially outward so as to align with the first annular member.

In a further step, the first annular member is rotated circumferentially relative to the second annular member in a second direction. The second direction may be opposite to the first direction. In other words, the first direction may be clockwise and the second direction may be counterclockwise or vice versa.

BRIEF DESCRIPTION OF THE DRAWINGS

FIGS. 15A-17 illustrate movement of an exemplary set of shuttle members in a section of an alternative embodiment of a device for braiding a plurality of filaments in a tubular braid according to the present invention.

DETAILED DESCRIPTION

Discussed herein are devices and methods for creating a tubular braid from a plurality of filaments. Because the braiding machine individually engages a subset of the filaments and moves the engaged filaments relative to the unengaged filaments in discrete steps to interweave the filaments, it does not create the large tension spikes common to the continuous motion braiding machines. Thus, the invention is particularly useful for making braided tubes of ultra-fine filaments, in the order of ½ mil-5 mil, for example, for use in vascular implants, such as embolization devices, stents, filters, gratis, and diverters for implantation in the human body. It will be appreciated, however, that the invention could also be advantageously be used for making braids for other applications and with other sized filaments.

The ability to individually engage a subset of filaments and move the filaments in discrete steps also allows for both flexibility in the loading of the machine and in the braid pattern created. The machine can be programmed to accept multiple loading configurations and create multiple braid patterns by alternating the subset of filaments engaged and/or the distance moved in each discrete step. For example while a one over-one under diamond braid pattern is shown and discussed, other braid or weave patterns, such as a two over-two under, two over-one under, one over-three under may also be used by varying the filaments engaged and the distances moved in each step. Likewise, by adjusting filaments engaged and the distances moved in each step, the machine can operate when loaded in a variety of configurations, i.e. fully loaded or partially loaded, to create tubular braids with differing numbers of filaments.

It also may be desirable to vary the size of the plurality of filaments. For example, in some uses for implantation in the human body discussed above, the need for stiffness and strength must be balanced with the need to collapse the braid into a small delivery size. Adding several larger diameter filaments to the braid greatly increases the radial strength without much increase in the collapsed diameter of the braid. The braiding machine described herein is able to accommodate different sizes of wires and thereby produce implants that optimize stiffness and strength as well as porosity and collapsed diameter.

Figure 1:
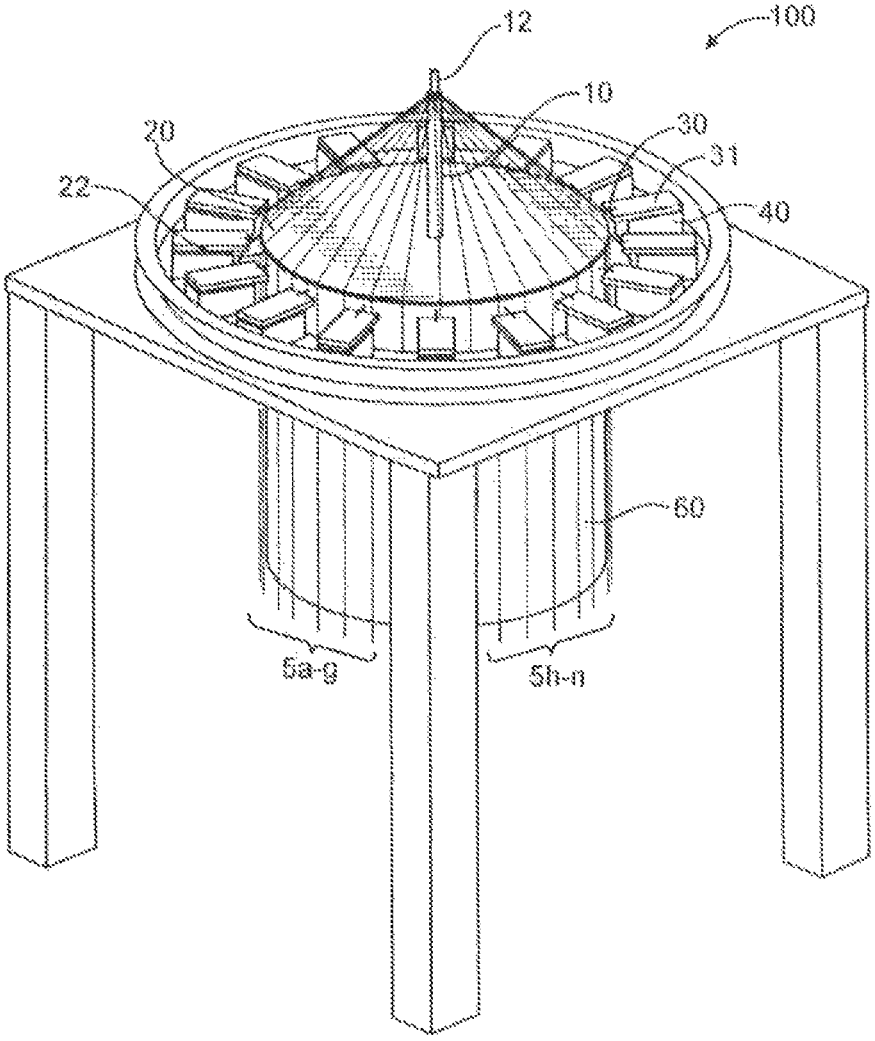
FIG. 1 illustrates an embodiment of a device for braiding a plurality of filaments in a tubular braid according to the present invention.
Figure 1A:
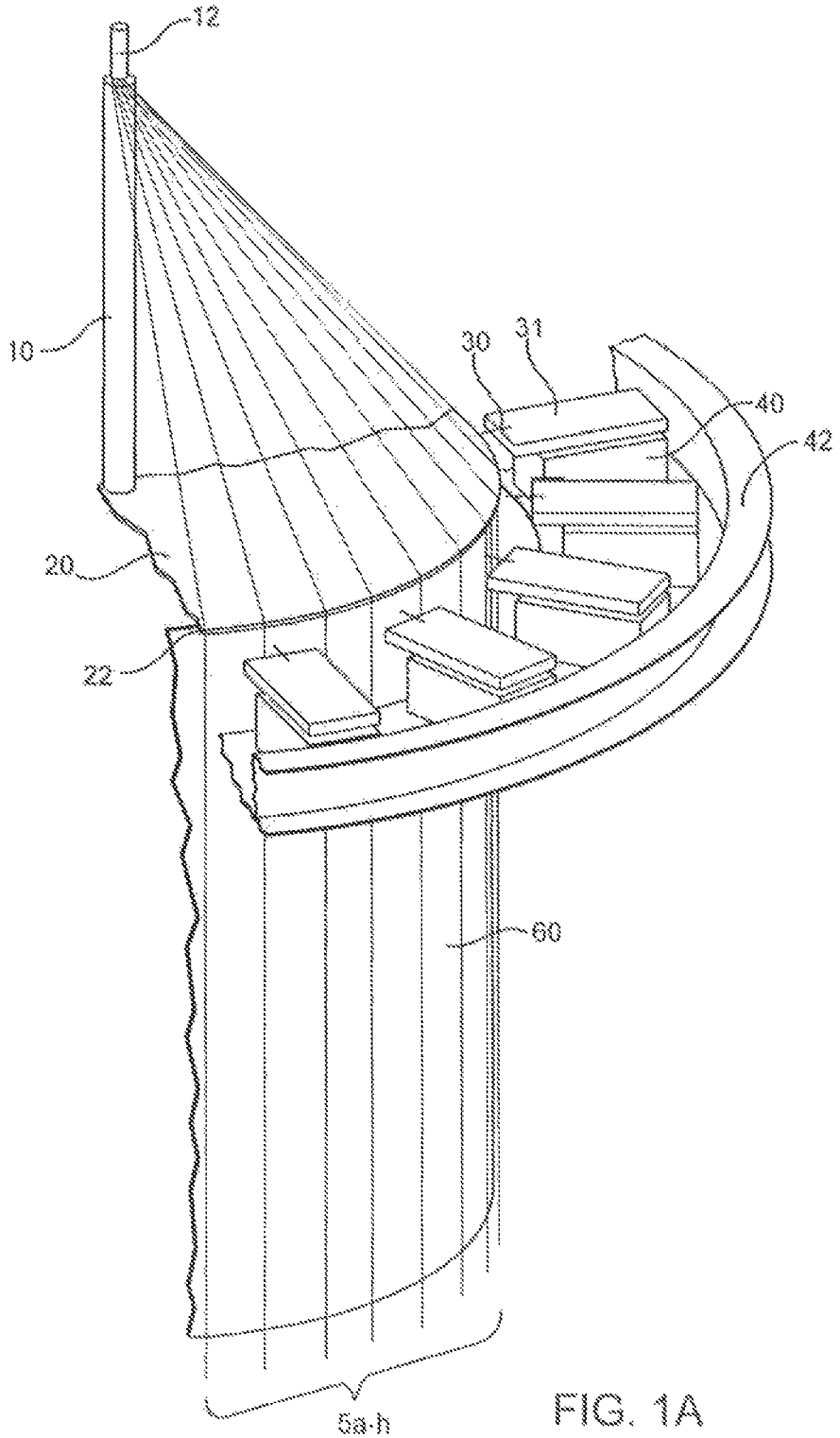
FIG. 1A illustrates a section of the device of FIG. 1 for braiding a plurality of filaments in a tubular braid according to the present invention.

As shown in FIGS. 1-1A, the braiding machine 100 is of the vertical type, i.e., the braiding axis BA of the mandrel 10, about which the braid 55 (see FIG. 2A) is formed, extends in the vertical direction. A vertical-type braiding apparatus provides more convenient access by the operator to various parts of the apparatus than a horizontal-type apparatus wherein the braid is formed about a horizontal axis. The braiding machine includes a circular disc 20, from which an elongate cylindrical braiding mandrel 10 extends perpendicularly. The diameter of the mandrel 10 determines the diameter of the braid formed thereon. In some embodiments, the mandrel may range from about 2 mm to about 50 mm. Likewise, the length of the mandrel 10 determines the length of the braid that can be formed. The uppermost end of the mandrel 10 has a tip 12 having a smaller diameter than mandrel 10 which forms a recess or notch for loading a plurality of filaments on the tip of mandrel 10. In use, a plurality of filaments 5*a-n* is loaded onto mandrel tip 12, such that each filament extends radially toward circumferential edge 22 of disc 20.

Figure 10:
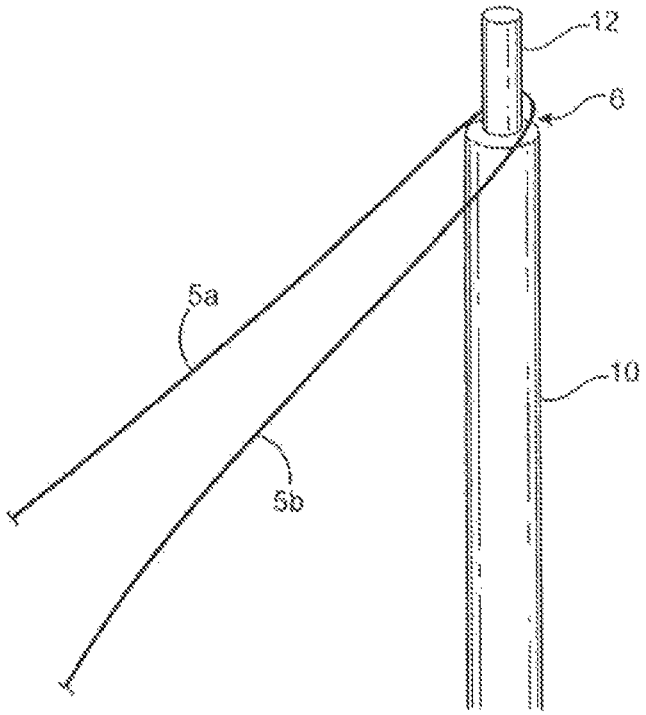
FIG. 10 illustrates an embodiment of a wire being loaded onto a mandrel to form two of the braiding filaments for use in the present invention.

The filaments may be looped over mandrel 10 such that the loop catches on the notch formed at the junction of tip 12 and mandrel 10. For example, as shown in FIGS. 1A and 10, each wire 6 will create two braiding filaments 5*a,b* once looped over and temporarily affixed to the mandrel 10. This offers better loading efficiency because each wire creates two braiding filaments. Alternatively, the filaments may be temporarily secured at the mandrel tip 12 by a constraining band, such as a band of adhesive tape, an elastic band, an annular clamp, or the like. The filaments 5*a-n* are arranged such that they are spaced apart around the circumferential edge 22 of disc 20 and each engage edge 22 at a point that is spaced apart a circumferential distance d from the points engaged by the immediately adjacent filaments.

In some embodiments, the mandrel may be loaded with about 10 to 1500 filaments, alternatively about 10 to 1000 filaments, alternatively about 10 to 500 filaments, alternatively about 18 to 288 filaments, alternatively 104, 144, 288, 360, or 800 filaments. In the event that a wire is draped over the mandrel, as described above and illustrated in FIG. 10, there would be ½ the number of filaments because each wire results in two braiding filaments. The filaments 5*a-n* may have a transverse dimension or diameter of about 0.0005 to 0.005 inches (½ to 5 mils), alternatively about 0.001 to 0.003 inches (1 to 3 mils). In some embodiments, the braid may be formed of filaments of multiple sizes. For example, filaments 5*a-n* may include large filaments having a transverse dimension or diameter that is about 0.001 to 0.005 inches (1-5 mils) and small filaments having a transverse dimension or diameter of about 0.0005 to 0.0015 inches (½-1.5 mils), more specifically, about 0.0004 inches to about 0.001 inches. In addition, a difference in transverse dimension or diameter between the small filaments and the large filaments may be less than about 0.005 inches, alternatively less than about 0.0035 inches, alternatively less than about 0.002 inches. For embodiments that include filaments of different sizes, the number of small filaments relative to the number of large filaments may be about 2 to 1 to about 15 to 1, alternatively about 2 to 1 to about 12 to 1, alternatively about 4 to 1 to about 8 to 1.

Circular disc 20 defines a plane and a circumferential edge 22. A motor, such as a stepper motor, is attached to disc 20 to rotate the disc in discrete steps. The motor and control system may be housed in a cylindrical drum 60 connected to the bottom side of the disc. In some embodiments, drum 60 may have a diameter about equal to disc 20 such that the longitudinal side of the of drum 60 can act as a physical mechanism to stabilize the filaments extending over the edge of the disc For example, in some embodiments, the side of the drum may be made of an energy absorbing, slightly textured, grooved surface, or surface having projections such that when the filaments extend over the edge of the disc, they will come to rest against the side of drum 60 such that the filaments are substantially vertical and not tangled.

Figure 7A:
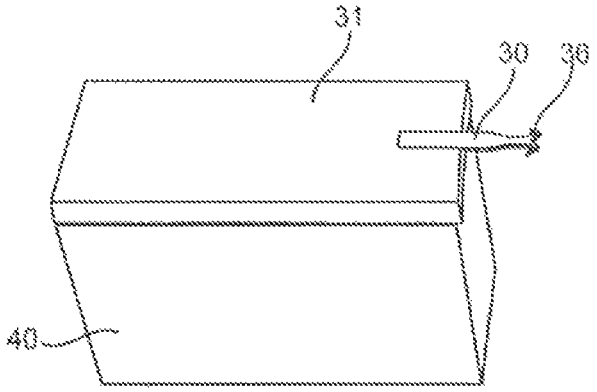
FIG. 7A illustrates an embodiment of a catching mechanism having a single hook and actuator for use in the present invention.

A plurality of catch mechanisms 30 (see FIG. 7A) are positioned around the circumference of disc 20, each catch mechanism 30 extending toward circumferential edge 22 of disc 20 and arranged to selectively capture an individual filament 5 extending over the edge of disc 20. The catch mechanisms may comprise hooks, barbs, magnets, or any other magnetic or mechanical component known in the art that is capable of selectively capturing and releasing one or more filaments. For example, as shown in FIG. 7A, in one embodiment, the catch mechanism may comprise a double headed hook 36 at the distal end for engaging a filament located on either side of the catch mechanism. The curve of the hooks may be slightly J-shaped, as shown, to encourage retention of the filament in the hook. Alternatively, the hooks may be more L-shaped to facilitate release of an engaged filament when the hook is rotated away from the filament The number of catch mechanisms determines the maximum number of filaments that can loaded on the braiding machine, and therefore, the maximum number of filaments in a braid made thereon. The number of catch mechanisms will generally be ½ the maximum number of filaments. Each catch mechanism may handle two threads (or more); therefore, for example, a braiding machine having 144 catch mechanisms extending circumferentially around disc 20 can be loaded with a maximum of 288 filaments. Because each of catch mechanism 30 is individually activated, however, the machine can also be operated in a partially loaded configuration loaded with any even number of filaments to create braids having a range of filaments.

Each catch mechanism 30 is connected to an actuator 40 through a coupler 31. Actuator 40 controls the movement of the catch mechanism toward and away from circumferential edge 22 of disc 20 to alternately engage and release filaments 5 one at a time. Actuator 40 may be any type of linear actuator known in the art such as electrical, electromechanical, mechanical, hydraulic, or pneumatic actuators, or any other actuators known in the art that are capable of moving catch mechanism 30, and an engaged filament 5, a set distance both away from and toward disc 20. Catch mechanism 30 and actuators 40 are positioned around the circumference of the disc such that the motion of the actuators causes the catch mechanisms to be moved in a generally radial direction away from and toward circumferential edge 22 of disc 20. Catch mechanisms 30 are further positioned such that catch mechanisms 30 engage the selected filament 5 as it extends over the circumferential edge of disc 20. For example, in some embodiments, the catch mechanisms are located in a horizontal plane and slightly beneath the plane defined by disc 20. Alternatively, the catch mechanisms may be angled such that when they are moved toward the disc, they will intercept the filament at a point below the plane defined by disc 20. As shown in FIG. 1A, in some embodiments, the plurality of catch mechanisms 30 and actuators 40 may be attached to a rotatable circular track 42. A motor, such as a stepper motor, may be attached to circular track 42 to rotate catch mechanisms 30 in discrete steps relative to disc 20. Alternatively, the plurality of catch mechanisms 30 and actuators 40 may be attached to a stationary track surrounding the circular disc.

Figure 1B:
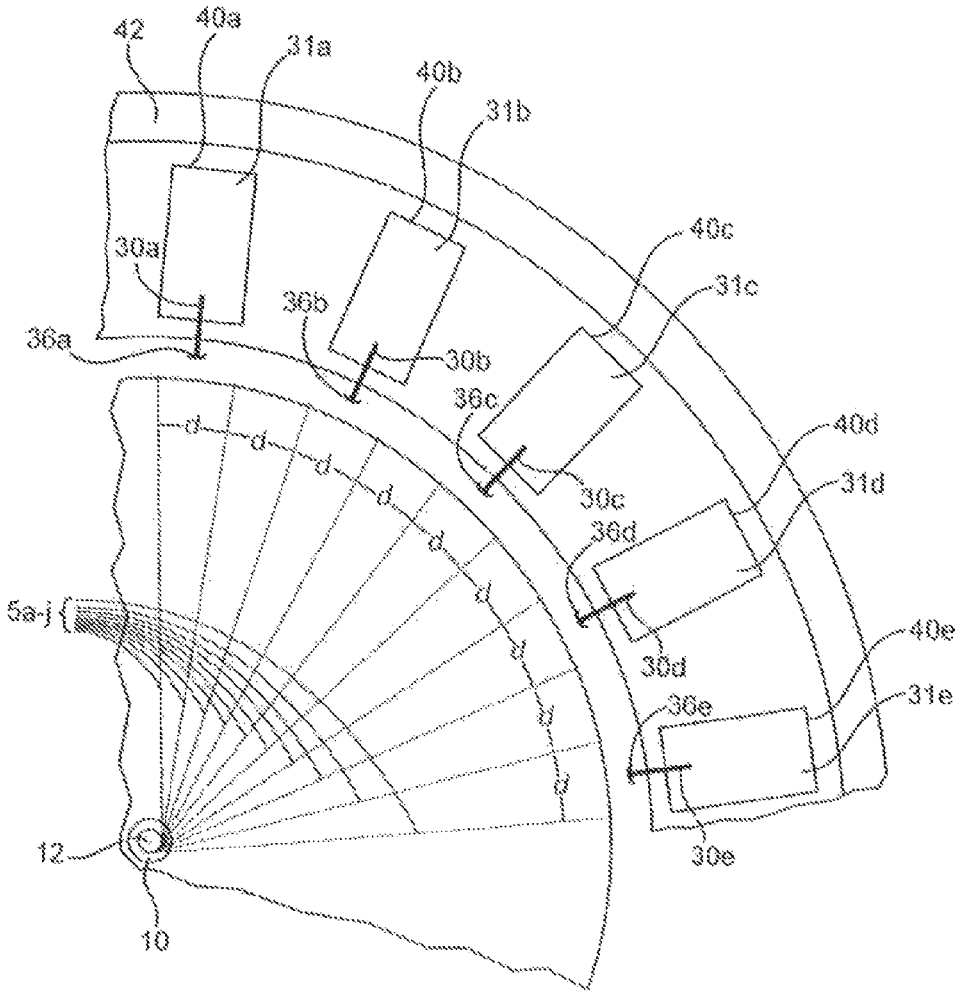
FIG. 1B is a plan view of the section of the device of FIG. 1A illustrating the braiding machine loaded with a plurality of filaments.

In use, as shown in FIGS. 1B-F, mandrel 10 is loaded with a plurality of filaments 5*a-j* which extends radially over circumferential edge 22 of circular disc 20. Each of filaments 5*a-j* engage circumferential edge 22 of disc 20 at a discrete point a distance d from the point engaged by each immediately adjacent filament. In some embodiments, the points of engagement may comprise of series of pre-marked locations specify identified, for example, by a physical marker. In other embodiments, the points of engagement may further comprise a physical feature such as microfeatures, texturing, grooves, notches, or other projections. As shown in FIG. 1B, catch mechanisms 30*a-c* are initially positioned equidistant between adjacent filaments 5*a-j*, i.e., catch mechanism 30*a* is positioned between filaments 5*a* and 5*b*, catch mechanism 30*b* is positioned between filaments 5*c* and 5*d*, catch mechanism 30*c* is positioned between filaments 5*e* and *f*, catch mechanism 30*d* is positioned between filaments 5 and h and catch mechanism 30*e* is positioned between filaments 5*i* and *j*. Each catch mechanism is further positioned with hooks located beyond the circumference of disc 20.

Figure 1C:
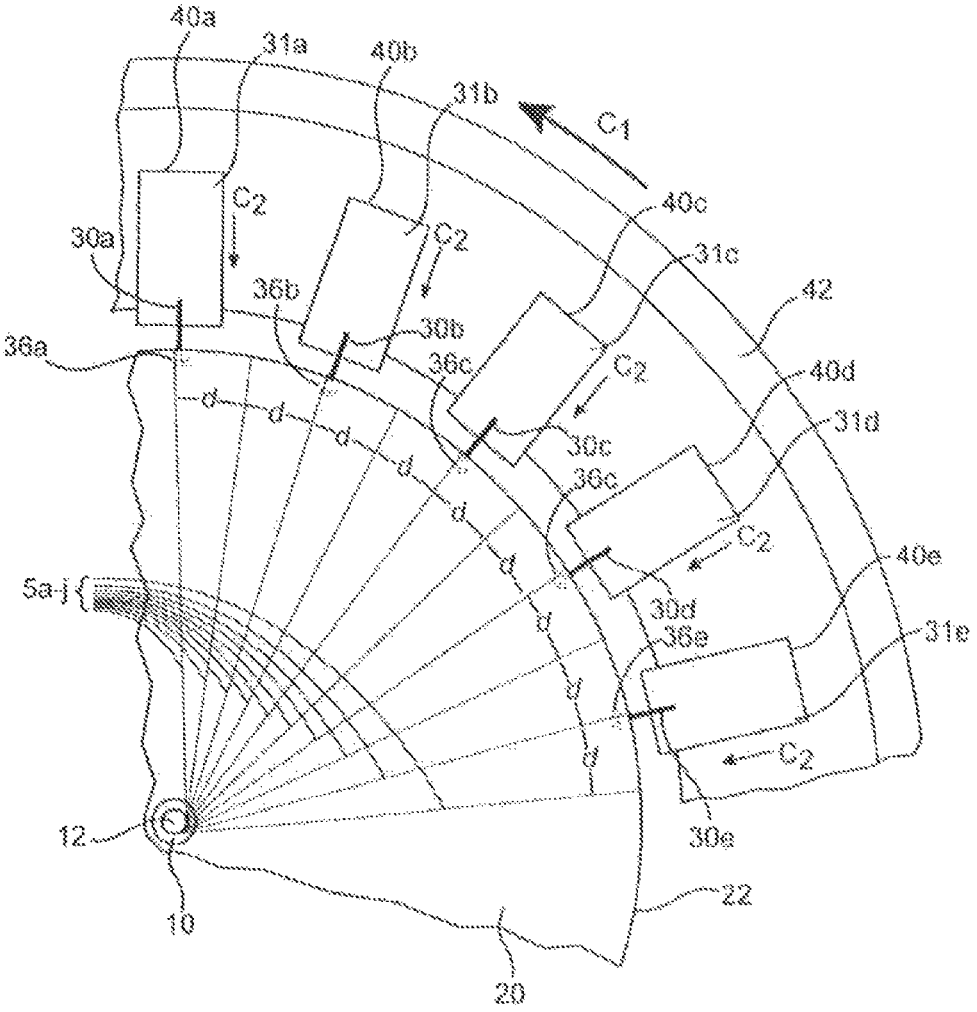
FIG. 1C is a plan view of the section of the device of FIG. 1A illustrating the catching mechanisms engaging a subset of the filaments.

To engage a first set of filaments 5*a,c,e,g*, and *i*, as shown in FIG. 1C, actuators 40*a-e* attached to catch mechanisms 30*a-e* are actuated to move each catch mechanism a discrete distance in a generally radial direction toward disc 20. The distal end of each catch mechanism 30*a-e* preferably engages filaments 5*a, c, e, g* and *i* at a point beneath the plane of circular disc 20 as the filaments extend over edge 22 of disc 20. For example, as illustrated here, once hooks 36*a-e* have been moved toward the disc in the direction C2 such that the tip of each hook 36*a-e* extends past hanging filaments 5*a, c, e, g*, and *i*, track 42 retaining catch mechanisms 30*a-e* is rotated counterclockwise, in the direction of arrow C1, to contact filaments 5*a, c, e, g*, and *i*. Alternately, disc 20 may be rotated in the clockwise direction to place the filaments 5*a, c, e, g*, and *i* in contact with catch mechanisms 30*a-e* in a similar manner.

Figure 1D:
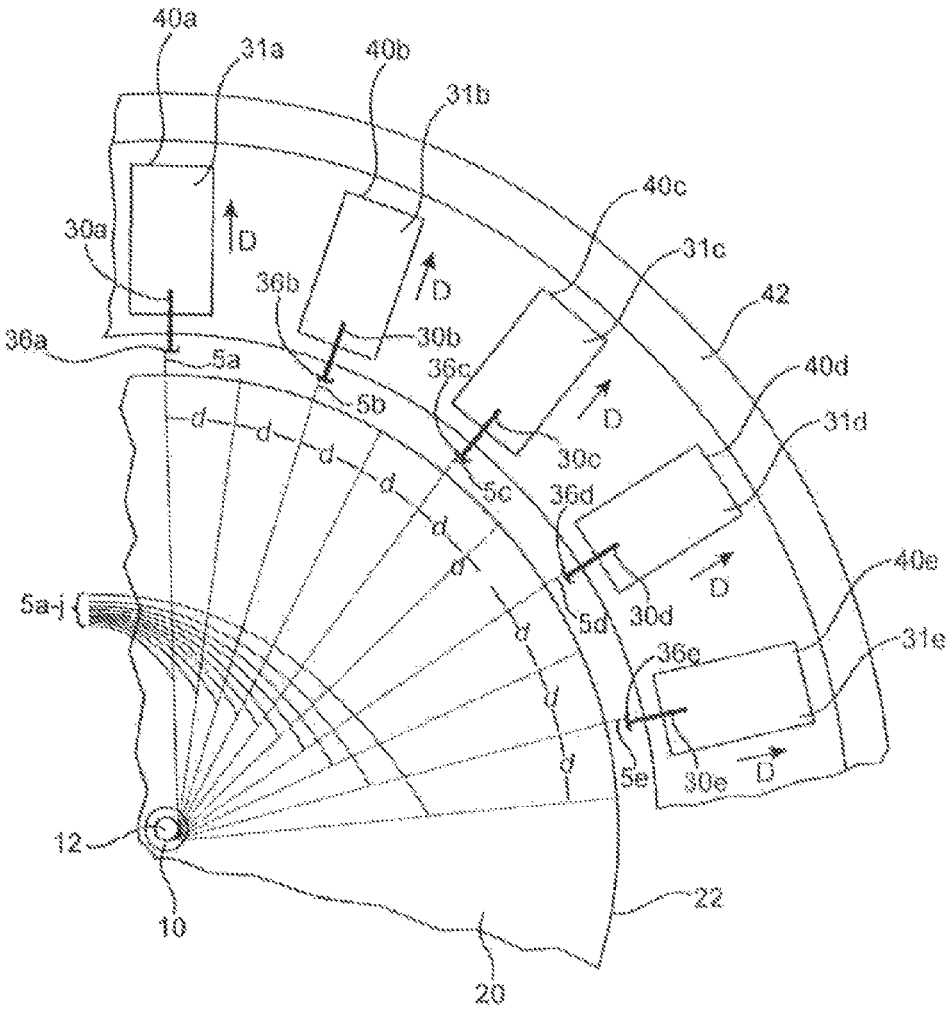
FIG. 1D is a plan view of the section of the device of FIG. 1A illustrating the catching mechanisms pulling the engaged filaments beyond the edge of the disc.

As shown in FIG. 1D, once filaments 5*a, c, e, g*, and *i* contact catch mechanisms 30*a-e*, the actuators attached to catch mechanisms 30*a-e* through couplers 31*a-e* are again actuated to retract catch mechanisms 30*a-e* in the direction of arrow D, engaging filaments 5*a, c, e, g*, and *i* in hooks 36*a-e* and moving engaged filaments 5*a, c, e, g*, and *i*, away from circumferential edge 22 of disc 20 in a generally radial direction to a point beyond edge 22 of disc 20.

Figure 1E:
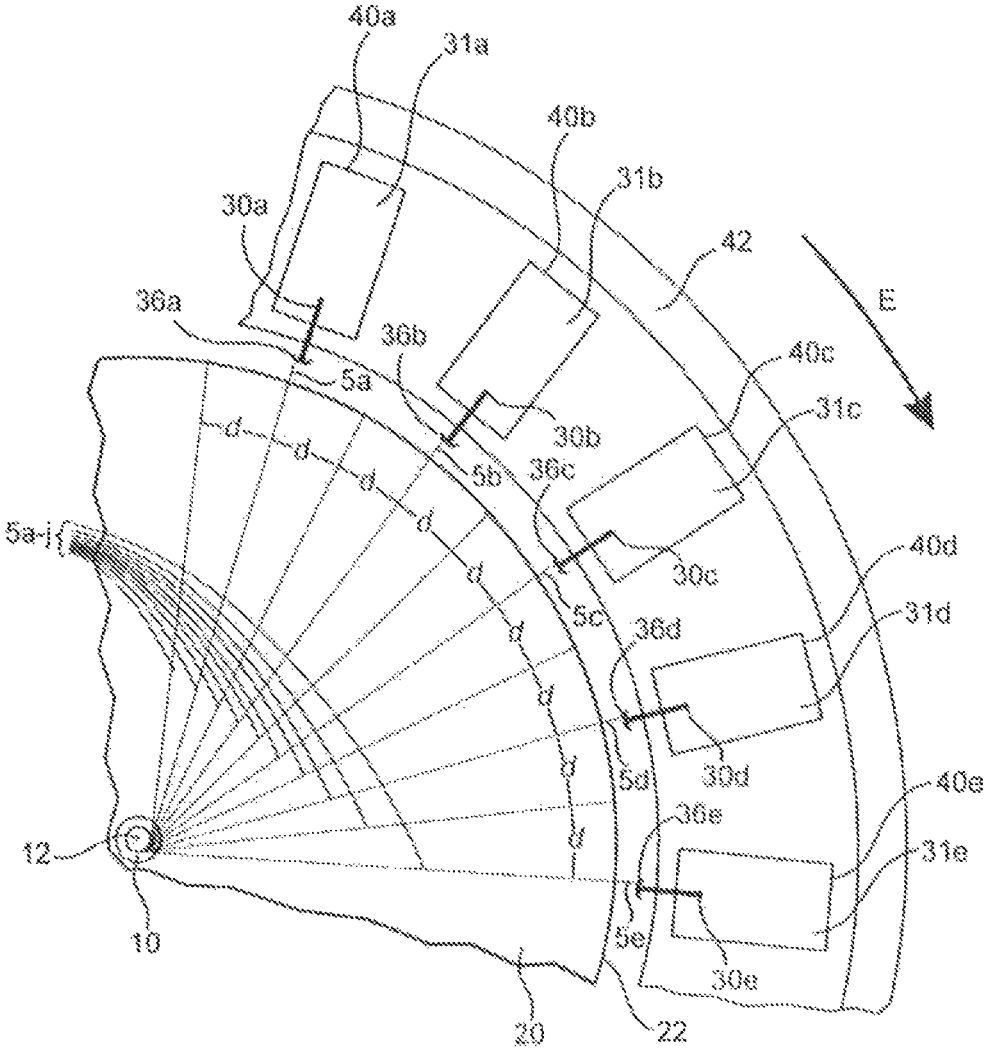
FIG. 1E is a plan view of the section of the device of FIG. 1A illustrating the engaged filaments crossing over the unengaged filaments.

Next, as shown in FIG. 1E, track 42 is rotated clockwise a distance of 2d, in the direction of arrow E, to cross engaged filaments 5*a, c, e, g*, and *i* over unengaged filaments 5*b, d, f, h*, and *j*. Alternatively, as discussed above, the same relative motion can be produced by rotating disc 20 in a counterclockwise direction a distance of 2d.

Figure 1F:
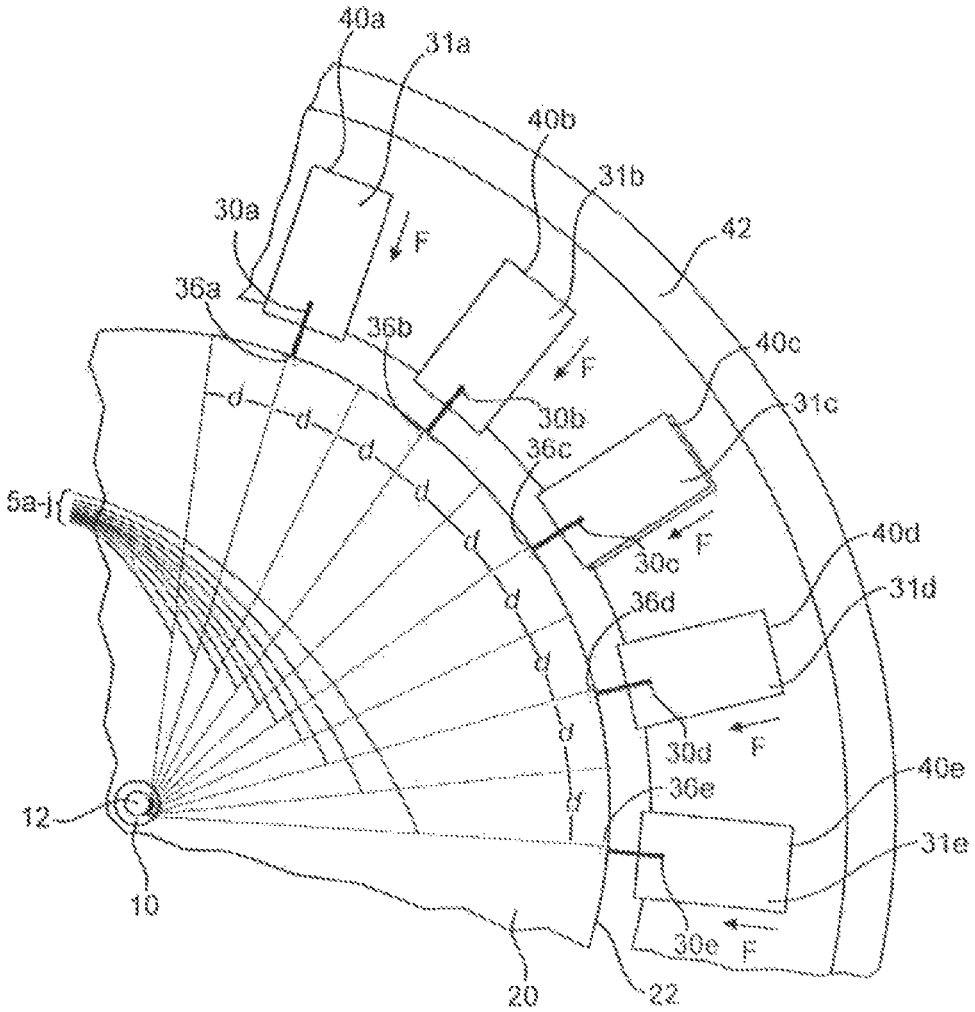
FIG. 1F is a plan view of the section of the device of FIG. 1A illustrating catching mechanisms releasing the engaged filaments.

Next, as shown in FIG. 1F, actuators 40*a-e* attached to catch mechanisms 30*a-e* are again actuated to move the catch mechanisms a discrete distance in a generally radial direction toward disc 20, as indicated by arrow F. The hooks 36*a-e* are thereby moved toward disc 20 such that the tip of each hook 36*a-e* extends inside the circumference formed by the hanging filaments. This will again place filaments 5*a, c, e, g*, and *i* in contact with edge 22 of disc 20 and release filaments 5*a,c,e,g*, and *i*. In addition, when catch mechanisms 30*a-e* are rotated in a clockwise direction, filaments 5*d, f, h*, and *j* are engaged by double hooks 36*a-d* on catch mechanism 30*a-d*. The same steps can then be repeated in the opposite direction to cross filaments 5*b, d, f, h*, and *j* over unengaged filaments 5*a, c, e, g*, and *i* to interweave the filaments in a one over-one under pattern.

Figure 2A:
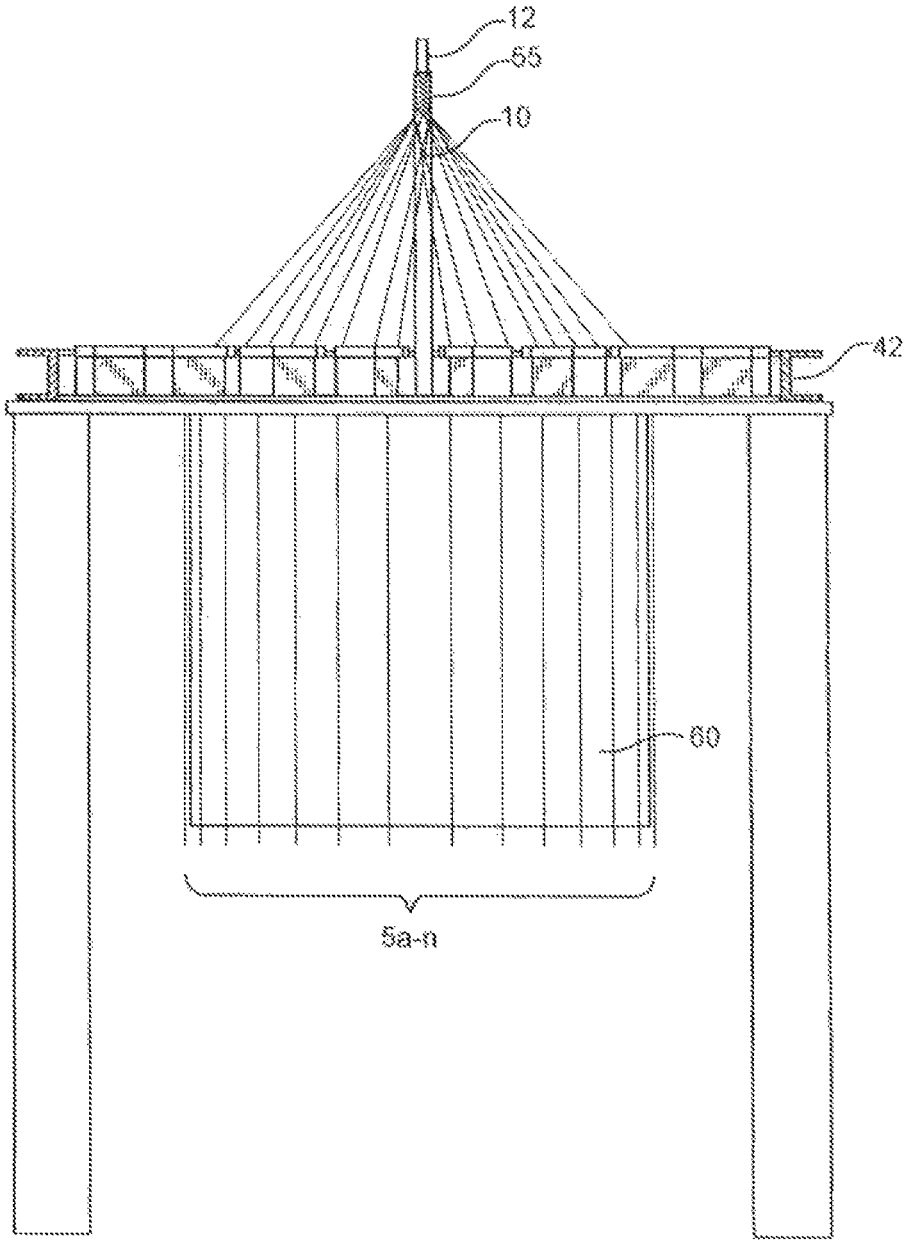
FIG. 2A illustrates a tubular braid being built on the mandrel of embodiment shown in FIG. 1.

As shown in FIG. 2A, filaments 5*a-n* are thus progressively woven into braid 55 about mandrel 10 from uppermost tip 12 towards the lower end of the mandrel extending from the circular disc. The steps illustrated in FIGS. 1B-1D create a braid 55 in a one over-one under pattern, i.e. a diamond pattern, however, any number of braid patterns may be created by varying the subset of threads engaged, the distances rotated, and/or the pattern of repetition.

Figure 2B:
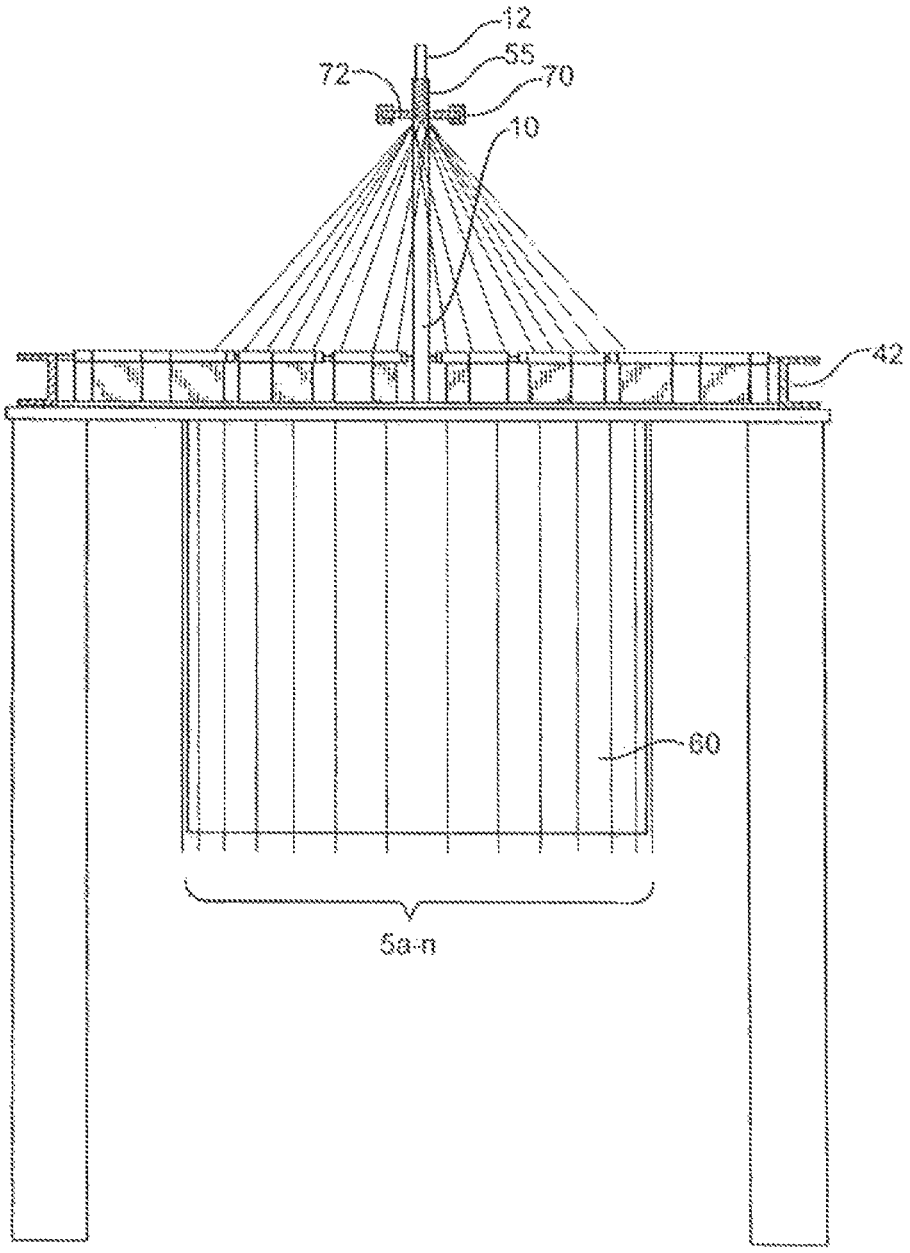
FIG. 2B illustrates an adjustable former ring on the tubular braid being built on the mandrel of the embodiment shown in FIG. 1.
Figure 2C:
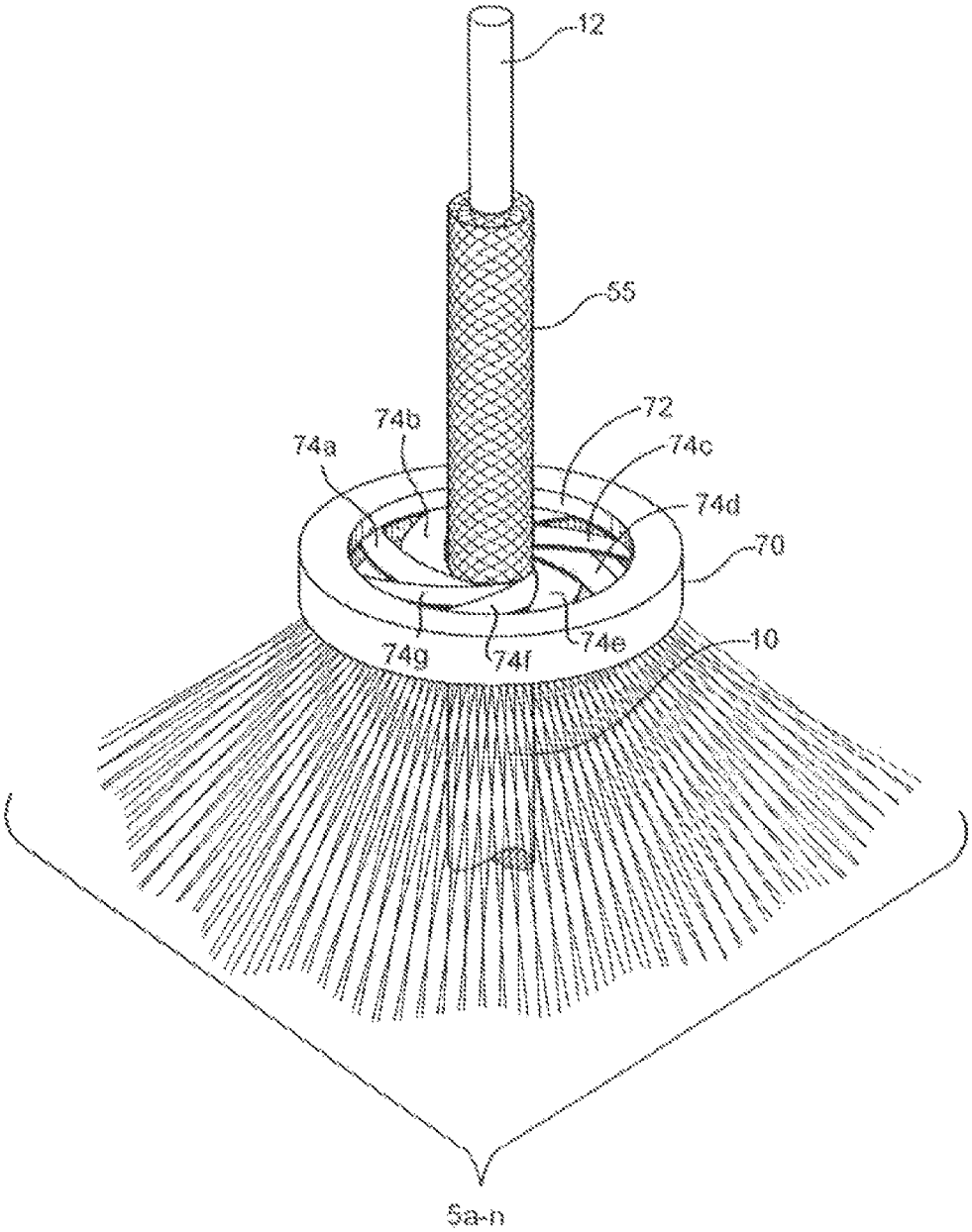
FIG. 2C is a perspective view of the adjustable follower ring.

As shown in FIG. 2B, at the point where filaments 5*a-n* converge to form the braid, i.e. the fell or braid point, former ring 70 is used in combination with mandrel 10 to control the dimension and shape of the tubular braid. Former ring 70 controls the outside diameter of braid 55 and a mandrel that controls the inside diameter. Ideally, former ring 70 inner diameter is just larger than the outer cross section of mandrel 10. In this way, former ring 70 pushes braided filaments 5*a-n* a short distance to mandrel 10 with a short path of travel so that braid 55 is pulled tightly against mandrel 10, thereby producing a uniform braid with high structural integrity. Former ring 70 having adjustable inner diameter 72, as illustrated in FIGS. 2B-C, can be adjusted t closely match the outer diameter of selected mandrel 10 and used to pull braid 55 tightly against mandrel 10. Adjustable former ring 70 is made by providing adjustable inner diameter 72, for example created by a plurality of overlapping leaves 74*a-h* in the form of an iris, which can be adjusted to provide a range of inner diameters. Such adjustable former rings are known in the art and more detail regarding the construction of such adjustable rings can be found in U.S. Pat. No. 6,679,152, entitled "Forming Ring with Adjustable Diameter for Braid Production and Methods of Braid Production," issued on Jan. 20, 2004, which is hereby incorporated by reference in its entirety.

Figure 2D:
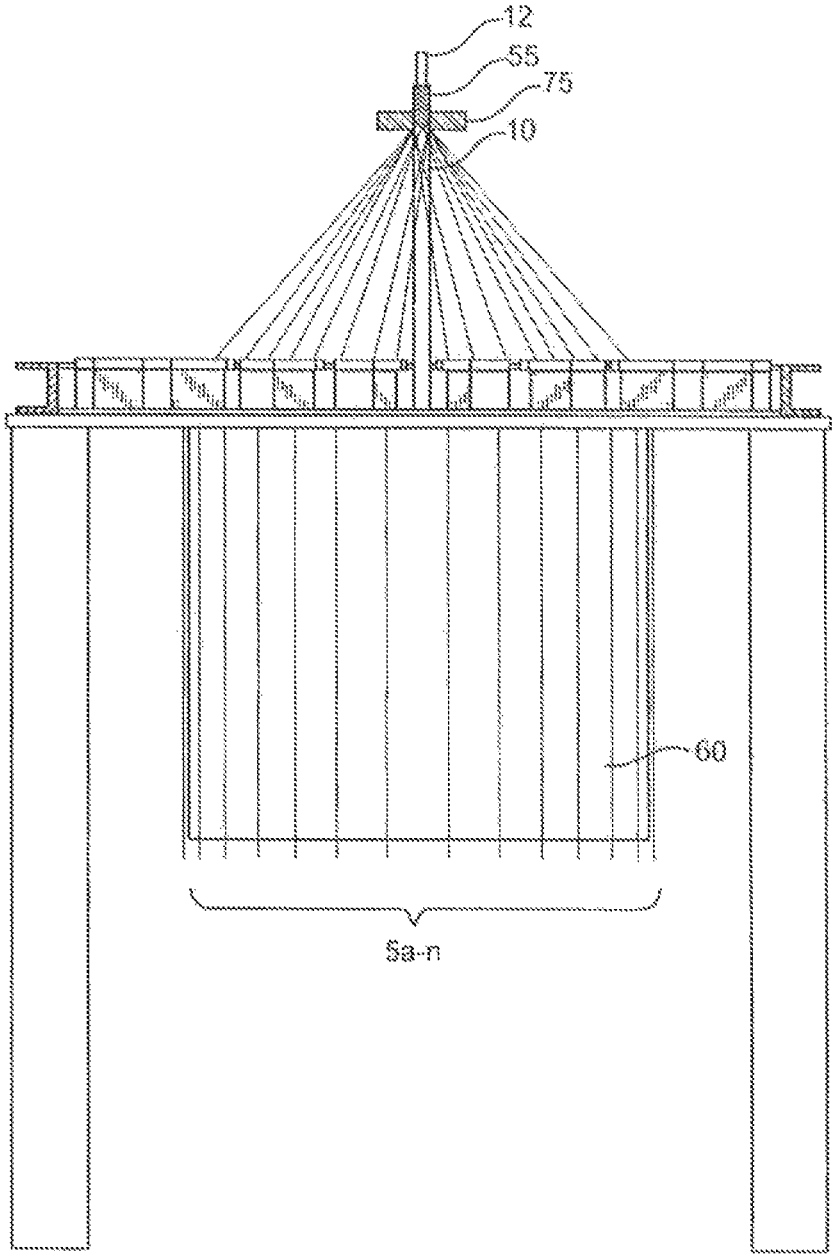
FIG. 2D illustrates a weighted former ring on the tubular braid being built on the mandrel of the embodiment shown in FIG. 1.

Alternatively, a fixed former ring 75 having a predetermined and non-adjustable inner diameter that closely matches the outer diameter of mandrel 10 can be used to pull braid 55 tightly against mandrel 10. In some embodiments, as shown in FIG. 2D, former ring 75, may be weighted to provide an additional force pushing down on filaments 5*a-n* as they are pulled against mandrel 10 to form tubular braid 55. For example, former ring 75 may include a weight of between about 100 grams to 1000 grams, alternatively of between about 200 grams to 600 grams, depending on the type and size of filaments used, to provide an additional downward force on filaments 5*a-n* pulled through former ring 75 and as pushed against mandrel 10 to create tubular braid 55.

Figure 3:
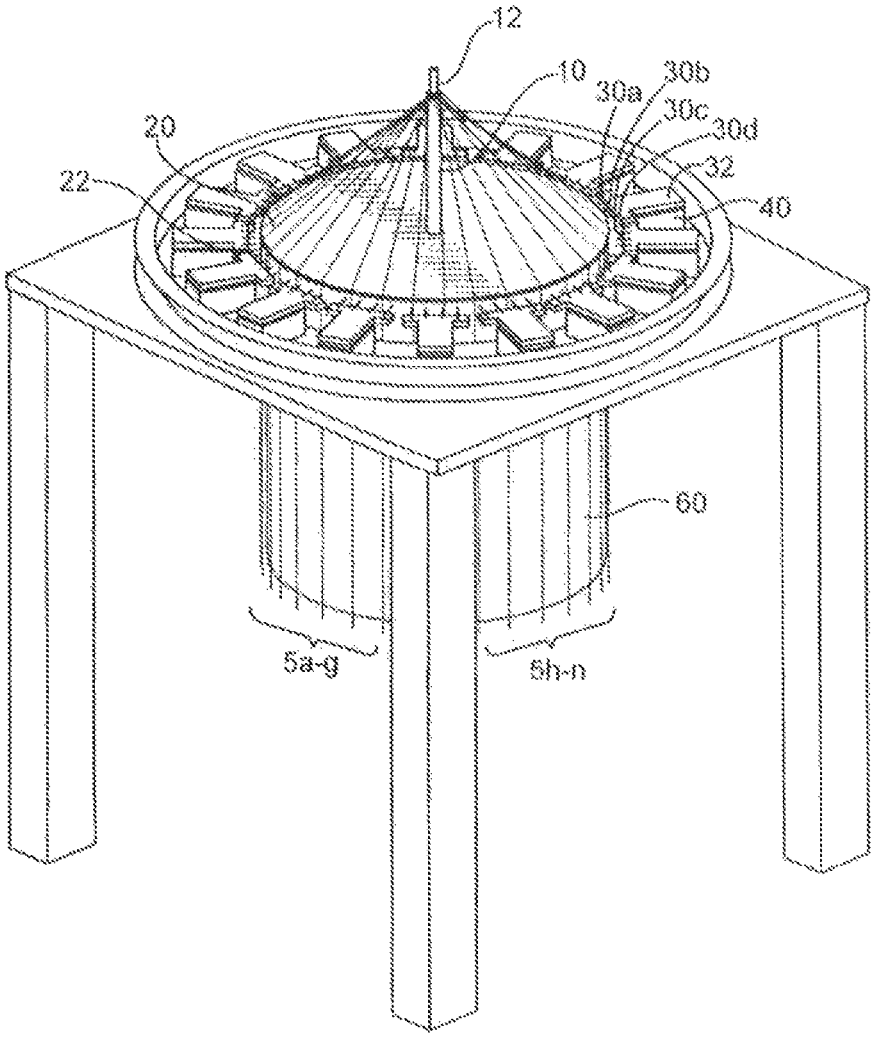
FIG. 3 illustrates an alternative embodiment of a device for braiding a plurality of filaments in a tubular braid according to the present invention
Figure 3A:
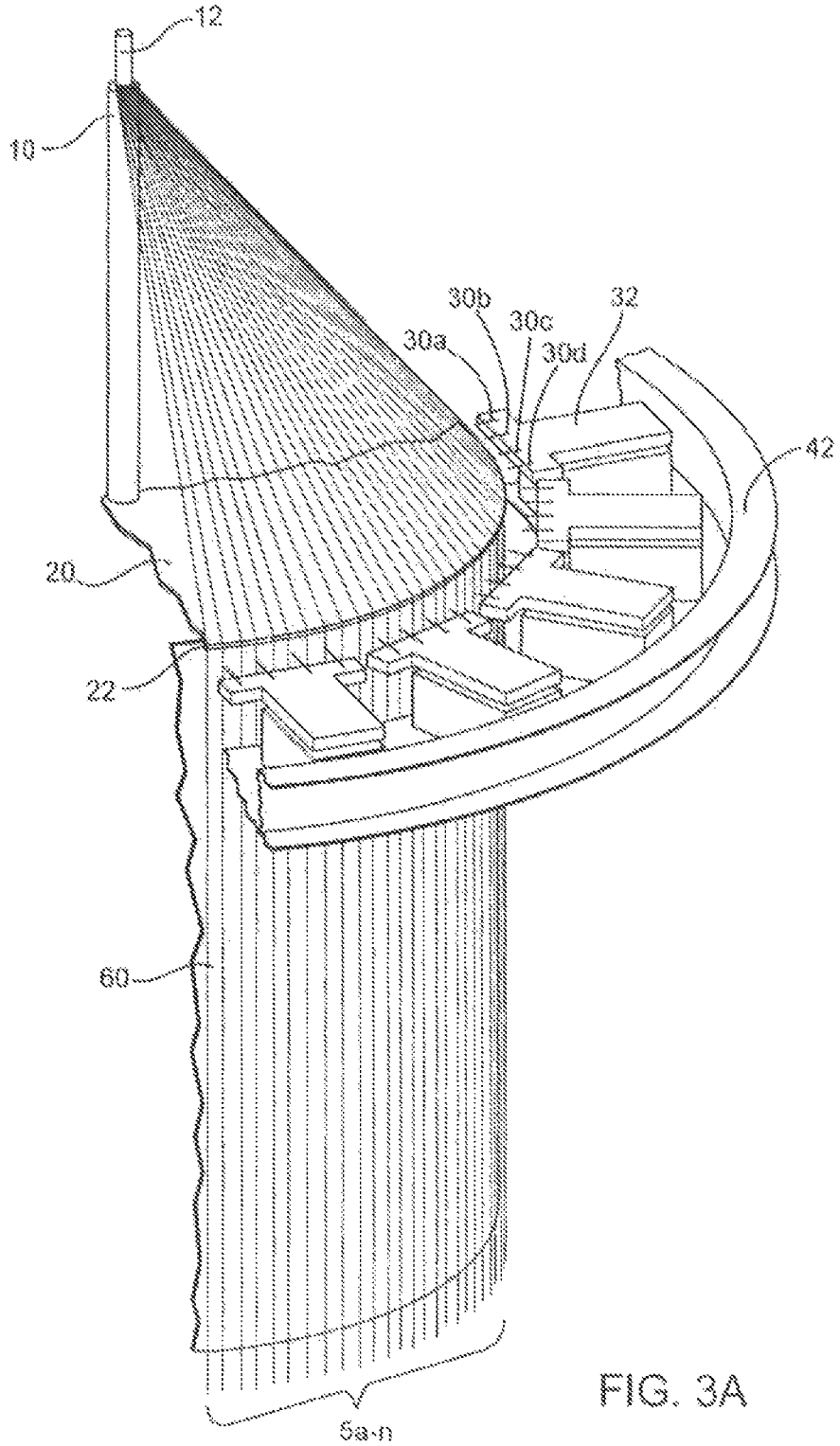
FIG. 3A illustrates a section of the device of FIG. 3 for braiding a plurality of filaments in a tubular braid according to the present invention.

As illustrated in FIGS. 3-3A, in an alternative embodiment, multiple catch mechanisms 30*a-d* may be located on a single "rake" 32 for efficiency. For example, as illustrated here, each rake 32 holds four catch mechanisms 30*a-d* (see also, FIG. 7C). Each rake is attached to an actuator 40, which simultaneously moves all four catch mechanisms 30*a-d* in a generally radial direction toward or away from circumferential edge 22 of disc 20 when actuated. This advantageously reduces the number of actuators needed to drive the catch mechanisms, and thereby increases the efficiency of the system. The angle at which each catch mechanism 30*a-d* moves when rake 32 is moved radially toward or away from disc 20 must be substantially radial to disc 20 to maintain consistency in the circumferential distances traveled by each filament as the filaments are engaged and the disc and/or catch mechanisms are rotated.

The motion of each individual catch mechanism 30*a-d* will not be precisely radial with respect to disc 20, however, it will have a radial component that is substantially radial. Because the angle with respect to radial that the catch mechanism is pulled increases with increasing circumferential distance from the axis of the linear motion, the number of catch mechanisms that can be carried by rake 32 is limited. Ideally, the upper limit for the angle of motion with respect to radial for each the catch mechanisms is about 45°, alternatively about 40°, alternatively about 35°, alternatively about 30°, alternatively about 25°, alternatively about 20°, alternatively about 15°, alternatively about 10°, alternatively about 5°, in order to maintain consistency in the relative circumferential distances move by the engaged filaments. For example, each rake may cover 90° of the 360° circumference when operating at an angle of 45° with respect to radial. In some embodiments, rake 32 may carry 1-8 catch mechanisms, alternatively 1-5 catch mechanisms, alternatively 1-4 catch mechanisms and still maintain an acceptable deviation from radial motion for all of the catch mechanisms carried thereon.

Figure 4:
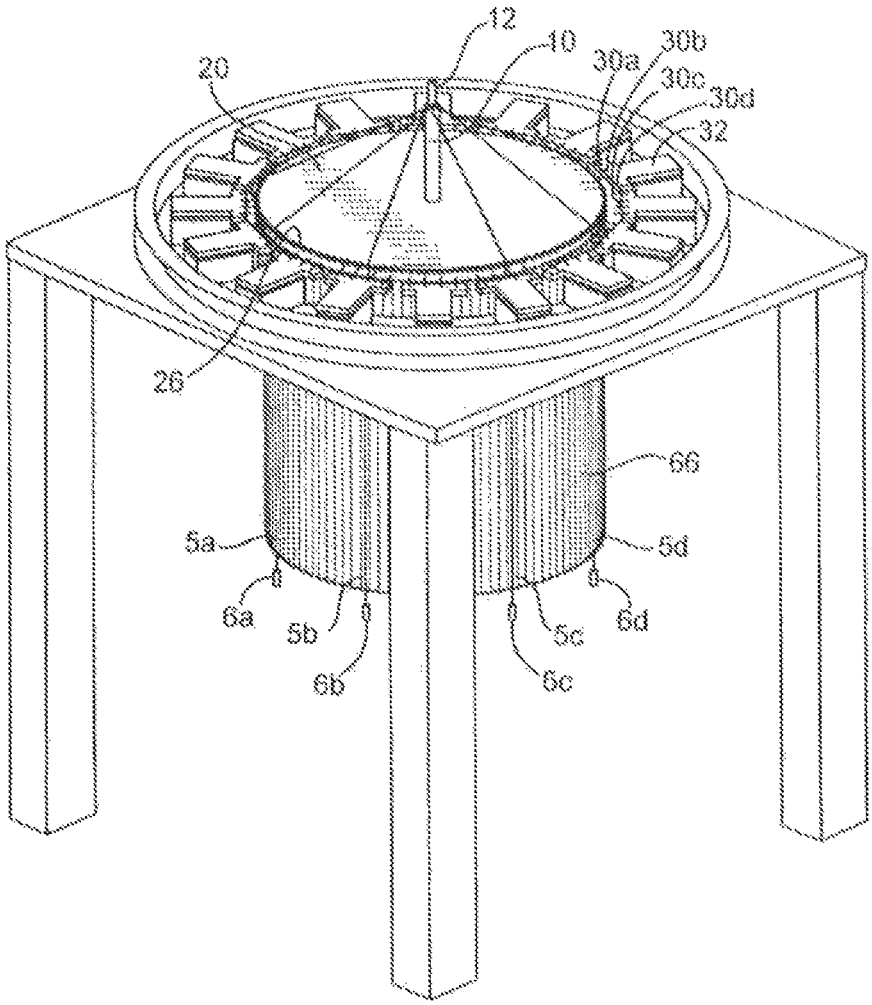
FIG. 4 illustrates an alternative embodiment of a device for braiding a plurality of filaments in a tubular braid according to the present invention.
Figure 4A:
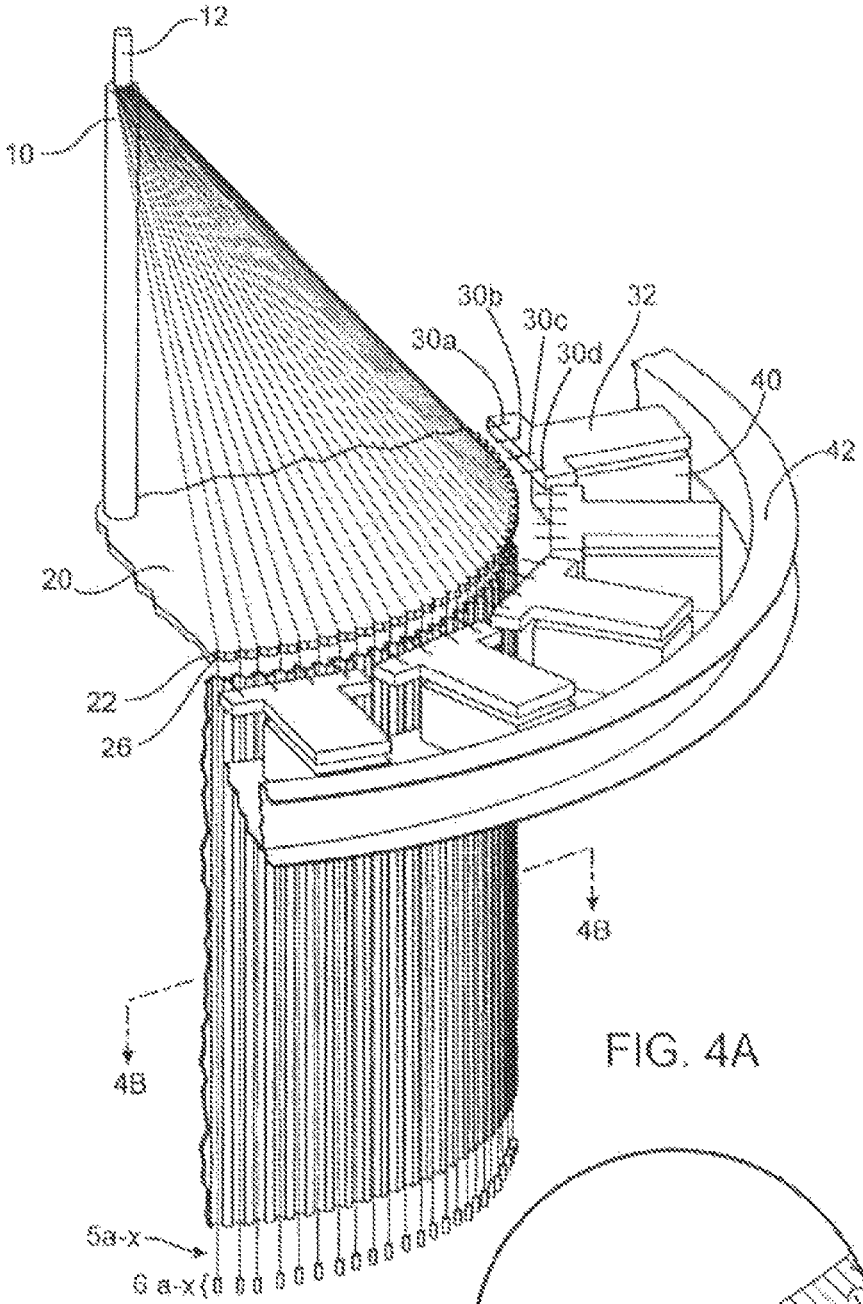
FIG. 4A illustrates a section of the device of FIG. 4 for braiding a plurality of filaments in a tubular braid according to the present invention.
Figure 4B:
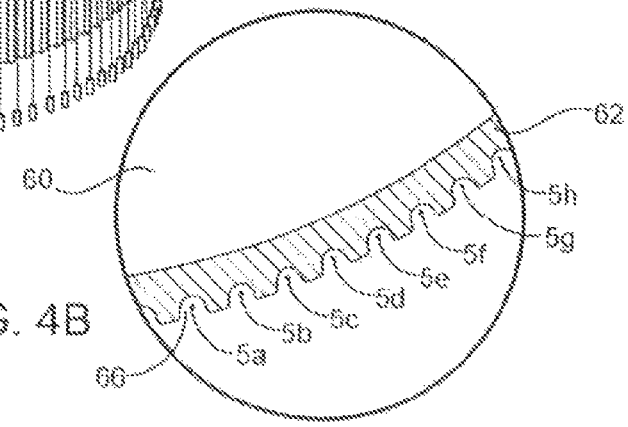
FIG. 4B illustrates a cross section of the corrugated guide for use with the device illustrated in FIG. 4A.

In addition, as shown in FIG. 4-4B, in some embodiments, circular disc 20 may have a plurality of notches 26 around circumferential edge 22 to provide a discrete point of engagement for each of the plurality of filaments 5*a-x* and ensure that filaments 5*a-x* remain in the order and spacing during the braiding process. In some embodiments, cylindrical drum 60 connected to the bottom side of disc 20 may also comprise a corrugated outer layer 62 comprising a plurality of corresponding grooves 66 extending longitudinally around the circumference of drum 60. Drum 60 may have a diameter substantially equal to the diameter of disc 20 such that longitudinal grooves 66 can act as an additional physical means to stabilize filaments 5*a-x* extending over the edge of disc 20 by providing individual grooves 66 in which each filament 5*a-x* will rest. Ideally, grooves 66 will be equal in number and aligned with the plurality of notches 26 in the circular disc. For example, in some embodiments, the circumferential edge of the disc may have between about 100-1500 notches, alternatively between about 100-1000 notches, alternatively between about 100-500 notches, alternatively between about 100-300 notches, alternatively 108, 144, 288, 360, or 800 notches. Similarly, in some embodiments the drum may have an outer layer with between about 100-1500 corresponding grooves, alternatively between about 100-1000 corresponding grooves, alternatively between about 100-500 corresponding grooves, alternatively between about 100-300 corresponding grooves, alternatively 108, 144, 288, 360, or 800 corresponding grooves.

The filaments may also be tensioned with a plurality of individual tensioning elements 6*a-x*, such as a weight, or any other tensioning element known in the art for applying between about 2-20 grams of weight to each of the individual filaments. Tensioning elements 6*a-x* are sized to fit in the plurality of grooves 66 on drum 60. For example, each tensioning element may comprise an elongate cylindrical weight as illustrated in FIGS. 4-4A. Tension elements 6*a-x* are separate for each filament 5*a-x* and are individually connected to each filament 5*a-x*. Therefore the amount of tension applied can be varied for each filament 5*a-x*. For example, a larger tensioning element can be attached to the smaller diameter filaments to apply more tension to the smaller diameter wires relative to the larger diameter wires. The ability to individually tension each filament creates an accurate tensioning system which improves the uniformity and integrity of the braid and enables the braiding machine to operate with multiple diameter wires.

Figure 5:
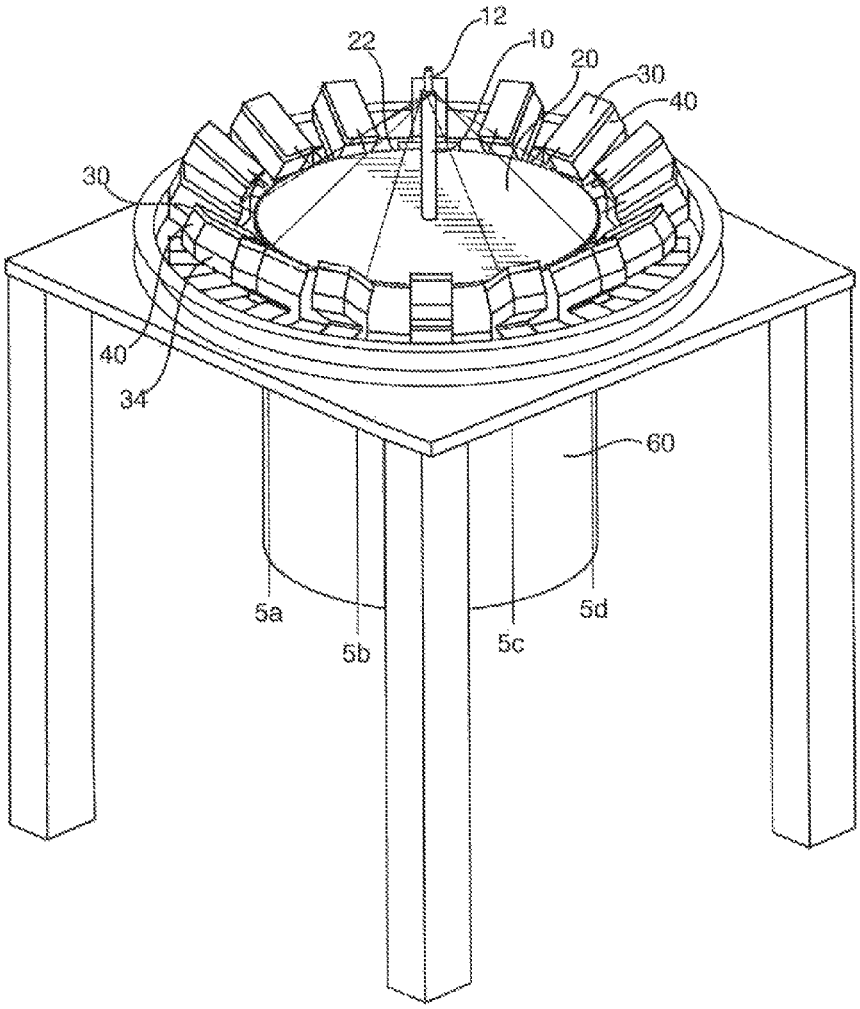
FIG. 5 illustrates an alternative embodiment of a device for braiding a plurality of filaments in a tubular braid according to the present invention.
Figure 6:
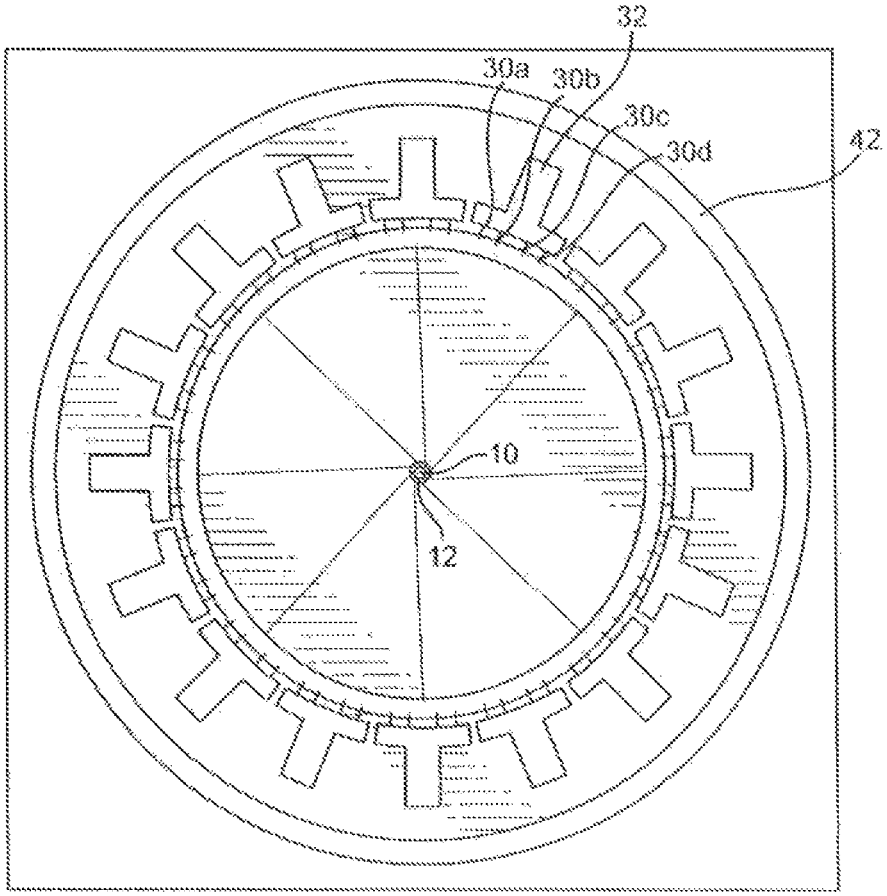
FIG. 6 illustrates a top view of the embodiment illustrated in FIG. 3 for braiding a plurality of filaments in a tubular braid according to the present invention.

In another alternative embodiment, as illustrated in FIG. 5, the plurality of catch mechanisms 30 and actuators 40 may be angled with respect to the plane of disc 20. Here, catch mechanism 30 and attached actuator 40 are mounted on an angled support bracket 34 (see FIG. 7C) to angle the catch mechanism and path of motion for the catch mechanism with respect to the plane of the disc. Catch mechanism 30 will still travel in a generally radial direction with respect to the circumferential edge of the disc 20. Here, however, the motion will also have a vertical component. Specifically, catch mechanism 30 and actuator 40 will be oriented at an angle of between about 15-60°, alternatively at an angle of between about 25-55°, alternatively at an angle of between about 35-50°, alternatively at an angle of between about 40-50°, alternatively at an angle of about 45° with respect to the plane of disc 20. The plurality of catch mechanisms 30 and actuators 40 will be positioned around circumferential edge 22 of disc 20, slightly elevated with respect to disc 20 such that the actuator 40 will move catch mechanism 30 toward circumferential edge 22 of the disc in a downward diagonal path from the point of elevation. Preferably, catch mechanism 30 will engage filament 5 extending over edge 22 of disc 20 at a point slightly below the plane of disc 20. In addition, when actuator 40 is actuated to move away from the circumferential edge of disc 20 with an engaged filament 5, filament 5 will be moved horizontally and vertically away from circular disc 20.

Figure 7B:
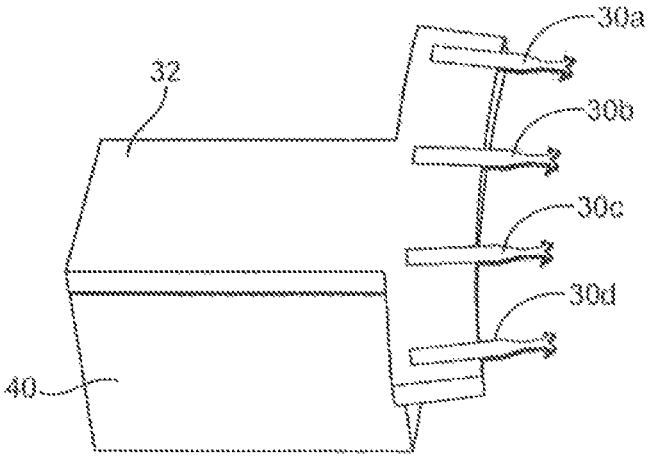
FIG. 7B illustrates an alternative embodiment of a catching mechanism having a plurality of hooks and actuators for use in the present invention
Figure 7C:
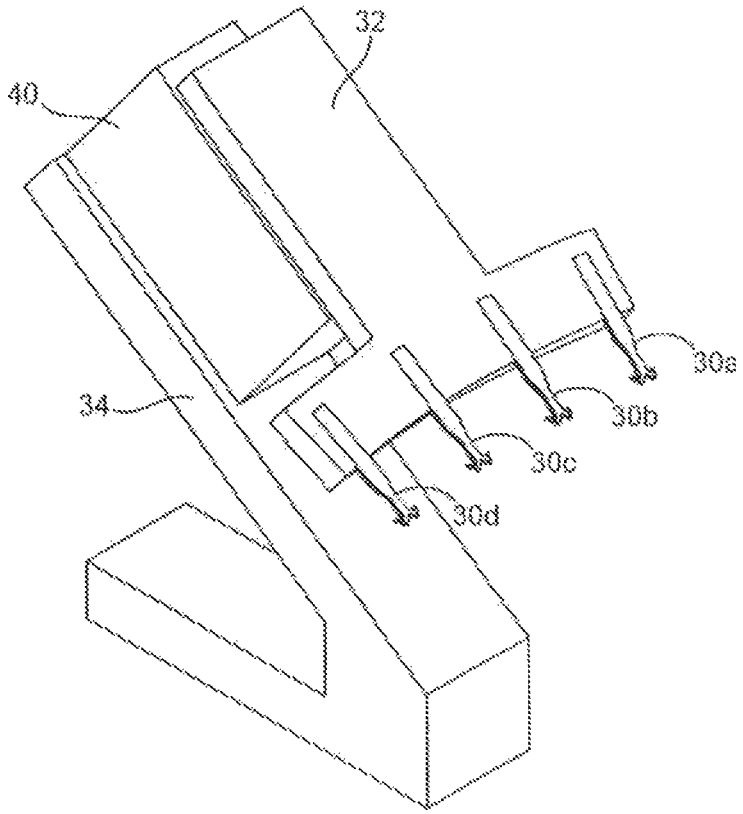
FIG. 7C illustrates an embodiment of an angled catching mechanism having a plurality of hooks and actuators for use in the present invention.

As shown in FIG. 7C, angled bracket 34 can also be used with rake 32 carrying multiple catch mechanisms 30*a-d* and actuator 40 to orient the rake 32 and actuator 40 with respect to the plane of disc 20 so that the path of motion for attached catch mechanisms 30*a-d* will be angled with respect to the plane of the disc 20. As discussed above, rake 32 and actuator 40 can be oriented at an angle of between about 15-60°, alternatively at an angle of between about 25-55°, alternatively at an angle of between about 35-50°, alternatively at an angle of between about 40-50°, alternatively at an angle of about 45° with respect to the plane of disc 20.

Other alternatives for the configuration of the horizontally oriented catch mechanisms discussed above are shown in more detail in FIGS. 7A and 7B. FIG. 7A illustrates an embodiment of a single catch mechanism 30 in combination with actuator 40. In this embodiment, each catch mechanism 30 is individually attached through coupler 31 to an actuator 40 for actuating the horizontal movement of the catch mechanism toward and away from the circular disc. Single catch mechanisms can be individually controlled to allow for flexibility in creating braiding patterns and in partially loading a braiding machine.

FIG. 7B illustrates an embodiment of a multiple catch mechanism-actuator device. In this embodiment, each actuator 40 is attached to a plurality of catch mechanisms 30*a-d* and collectively controls the catch mechanisms 30*a-d*. Catch mechanisms 30*a-d* may be mounted on rake 32 in an arcuate configuration, preferably mirroring the curve of disc 20. Rake 32 is then attached to actuator 40 for actuating the horizontal movement of rake 32, and therefore catch mechanisms 30*a-d* towards and away from the circular disc. Because the angle with respect to radial that the catch mechanism is pulled increases with increasing circumferential distance from the axis of the linear motion, the motion of each individual catch mechanism 30*a-d* will not be exactly radial with respect to disc 20. Because the motion of catch mechanisms 30*a-d* needs to be substantially radial, the number of catch mechanisms that can be carried by rake 32 may be limited. For example, rake 32 may carry between 1-8 catch mechanisms, alternatively between 1-5 catch mechanisms, alternatively between 1-4 catch mechanisms, and still maintain an acceptable deviation from radial motion for all of the catch mechanisms carried thereon.

Figure 8:
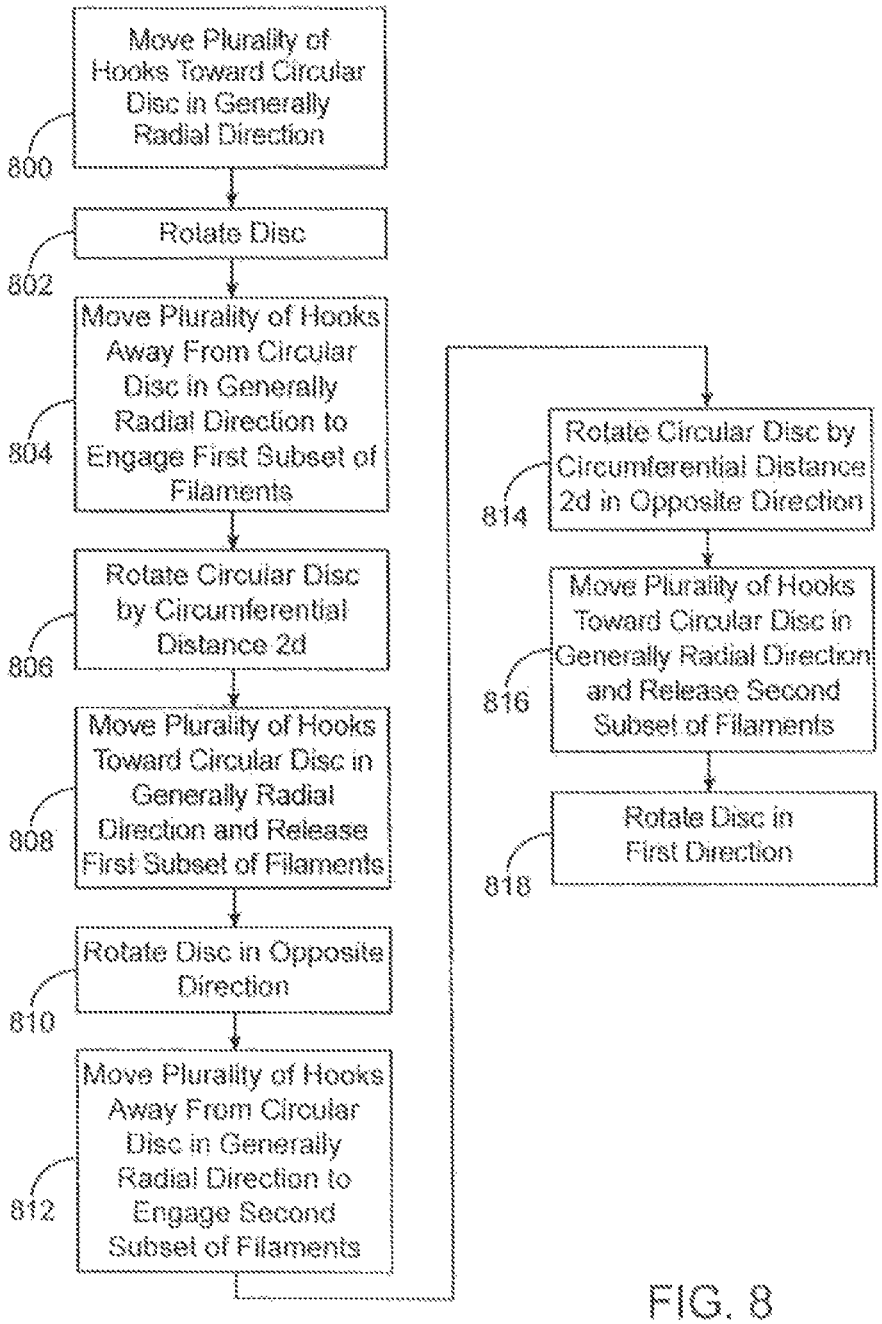
FIG. 8 is a flow chart illustrating a computerized method for controlling a device for braiding a plurality of filaments in a tubular braid according to the present invention.
Figure 9:
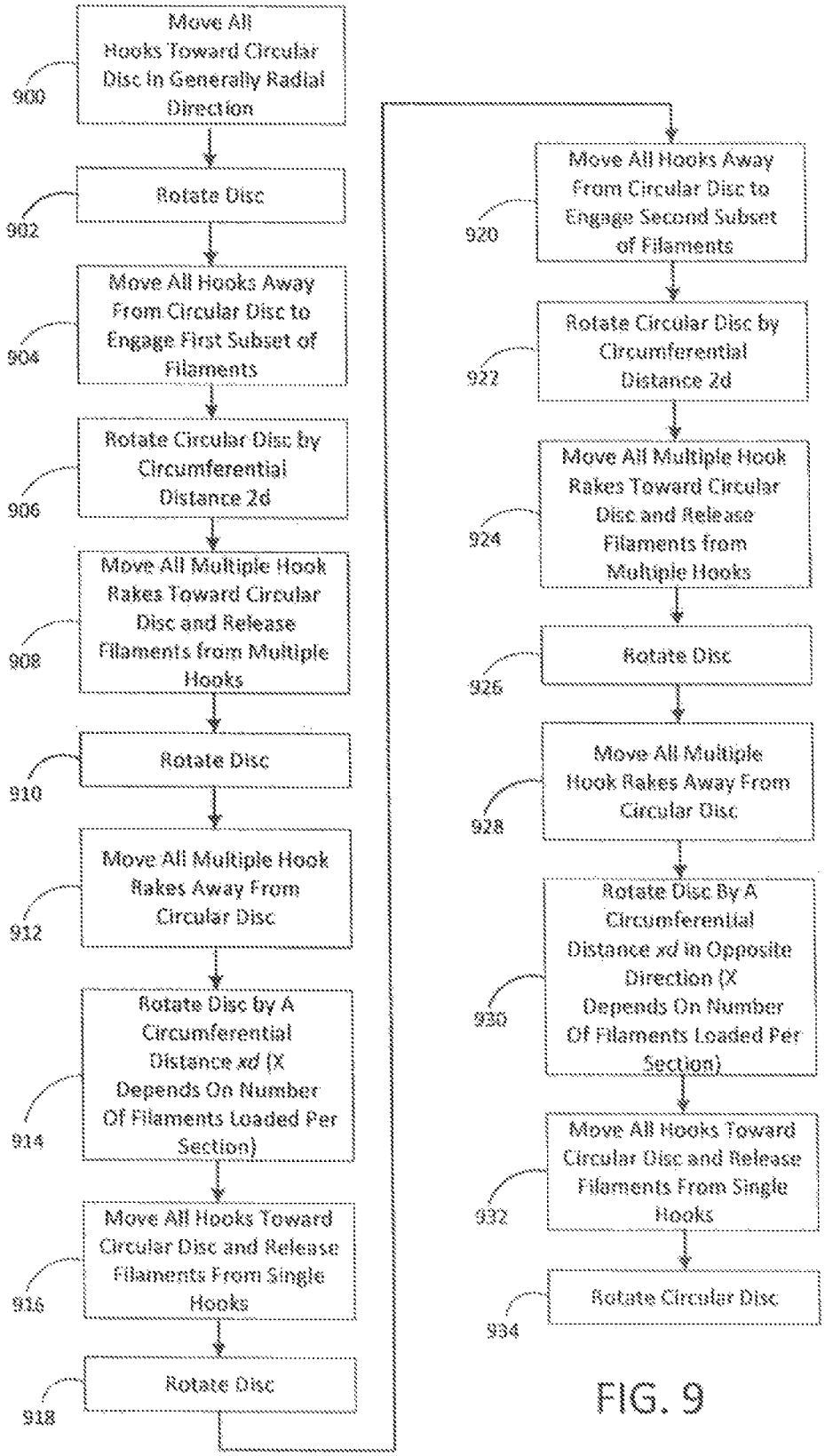
FIG. 9 is a flow chart illustrating a computerized method for controlling a device for braiding a plurality of filaments in a tubular braid according to the present invention.

It is further envisioned that a braiding machine according to the present invention could use a combination of the single and multiple catch mechanism embodiments arrayed around the circular disc to achieve the optimum balance between efficiency of the machine and flexibility in loading configurations and braiding patterns possible. As discussed above, the braiding machine can be operated to accept multiple loading configurations and create multiple braid patterns by alternating the subset of filaments engaged and/or the distance moved in each discrete step. Turning to FIGS. 8-9, the flow charts show examples of computerized instructions used to control the braiding machine in various loaded configurations.

In FIG. 8, the flow chart shows instructions for operating a braiding machine having a plurality of double headed hooks each operated individually by an actuator, such as shown in the embodiment illustrated in FIGS. 1-1E, for creating a simple one over-one under, or diamond, braid pattern. Once mandrel 10 has been loaded with a plurality of filaments 5*a-n* as shown in FIG. 1, software programmed with the following instructions for controlling the discrete movements of hooks or catch mechanisms 30 and circular disc 20 is initiated to operate the braiding machine in the method illustrated in FIGS. 1B-D to form a one over-one under braid on mandrel 10. At step 800, the actuators are actuated to move a plurality of hooks toward the circular disc in generally radial direction. At step 802, the disc is rotated in a first direction to engage a first subset of filaments. At step 804, the actuators are actuated to move the plurality of hooks away from the circular disk in a generally radial direction, thereby removing the engaged filaments from the circular disc. At step 806, the disc is rotate in the first direction by circumferential distance 2d to cross each of the unengaged filaments under an adjacent engaged filament. At step 808, the actuators are actuated to move the plurality of hooks toward circular disk in a generally radial direction. When the filaments engage the disc they are released from the hooks. At step 810, the disc is rotated in a second, opposite direction to engage a second subset of filaments. At step 812, the actuators are engaged to move the plurality of hooks away from circular disk in generally radial direction, thereby removing the engaged filaments from the circular disc. At step 814, the disc is rotated by a circumferential distance 2d in the second, opposite direction to cross each of the unengaged filaments under an adjacent engaged filament. At step 816, the actuators are engaged to move the plurality of hooks toward the circular disc in a generally radial direction. At step 818, the disc is rotated in the first direction to engage the first subset of filaments again. The instructions are then repeated from step 804 to create a one-over one under tubular braid on the mandrel.

In FIG. 9, the flow chart shows instructions are for operating a braiding machine having a plurality of rakes containing multiple double headed hooks each operated individually by an actuator alternating with a plurality of single double headed hooks each operated individually by an actuator. Once the mandrel 10 has been loaded with a plurality of filaments 5*a-n* as shown in FIG. 1, software programmed with the following instructions for controlling the discrete movements of hooks 30 and circular disc 20 is initiated to operate braiding machine 100. These instructions are more complex due to the combination of individual hooks and rakes of multiple hooks. This configuration of alternating individually actuated hooks and jointly actuated hooks, however, enables a reduction in number of actuators while still maintaining the flexibility in loading configurations.

Here, at step 900, the actuators are actuated to move all of the hooks toward the circular disc in a generally radial direction. At step 902, the disc is rotated in a first direction to engage alternating (even) wires. At step 904, the actuators are actuated to move all hooks away from the circular disc, thereby removing the engaged filaments from contact with the circular disc. At step 906, the disc is rotated in the first direction by circumferential distance 2d to cross each of the unengaged filaments under an adjacent engaged filament. At step 908 the actuators for the rakes of multiple hooks are actuated to move all of the multiple-hook rakes toward the circular disc until the wires engage the disc and are thus released from the multiple-hook rakes. At step 910, the disc is rotated. At step 912, the actuators for the rakes of multiple hooks are actuated to move all multiple-hook rakes away from the circular disc. At step 914, the disc is rotated in the first direction by a circumferential distance xd (x depends on number of wires loaded per section). At step 916, the actuators are actuated to move all hooks toward the circular disc until the wires engage the disc and are thus released. At step 918, the disc is rotated to engage alternating (odd) wires in all of the hooks. At step 920, the actuators are actuated to move all hooks away from the circular disc, thereby removing the engaged (odd) filaments from the circular disc. At step 922, the disc is rotated by circumferential distance 2d in the second, opposite direction to cross each of the unengaged (even) filaments under an adjacent engaged (odd) filament. At step 924, the actuators for the rakes of multiple hooks are actuated to move all multiple-hook rakes toward the circular disk disc until the wires engage the disc and are thus released. At step 926, the disc is rotated. At step 928, the actuators for the rakes of multiple hooks are actuated to move all multiple-hook rakes away from circular disc. At step 930, the disc is rotated by a circumferential distance xd in the second, opposite direction (x depends on number of wires loaded per section). At step 932, the actuators are actuated to move all hooks toward the circular disc until the wires engage the disc and are thus released. At step 934, the disc is rotated to engage alternating (even) wires in all of the hooks. These instructions are then repeated from step 904 to create a tubular braid on the mandrel.

Figure 11:
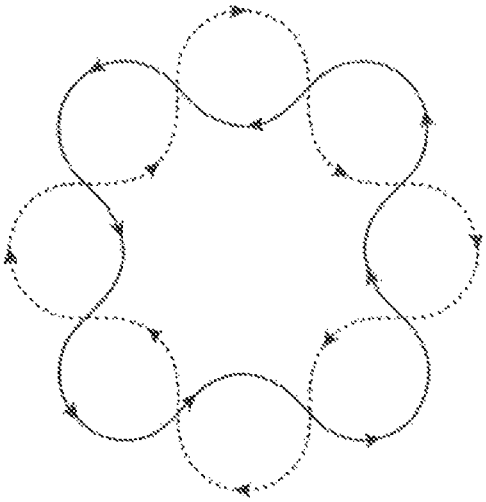
FIG. 11 illustrates generally circumferentially-extending sinuous paths around the axis of a braid.

Braiding machines may use slotted disks called horn gears to move bobbin carriers in connected semi-circular paths. As a result, as depicted in FIG. 11, the path of the filaments being braided define two continuous, generally circumferentially-extending sinuous paths that could also be described as serpentine or sinusoidal-like around the axis of the braid. The serpentine motion has simultaneous radial and arcuate motion.

Figure 12:
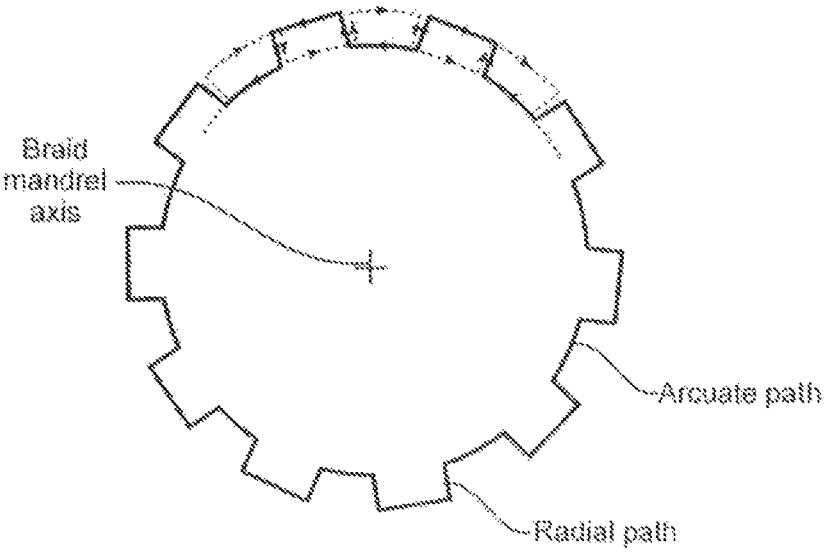
FIG. 12 illustrates a notched path around the axis of a braid resulting from alternating radial and arcuate movements of the filaments or spools.

In another embodiment, the device of this invention provides for movement of the filaments in a distinctly different non-continuous path. The filaments or spools (e.g., bobbins) are moved in a series of discrete radial and arcuate motions relative to the axis of the braid mandrel. In some embodiments, the movements of the filaments or spools alternate between radial and arcuate defining a notched or gear tooth-like path, as shown in FIG. 12.

Figure 13A:
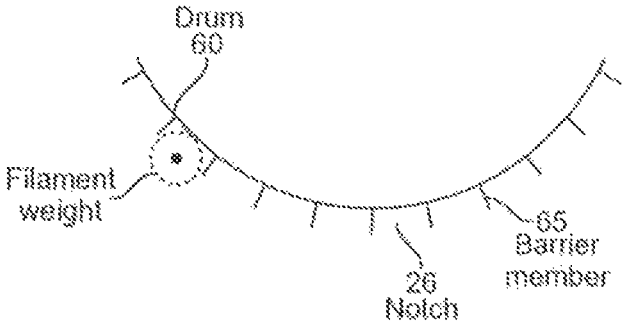
FIG. 13A illustrates an alternative embodiment of a device for braiding a plurality of filaments in a tubular braid that includes a plurality of barrier members.
Figure 13B:
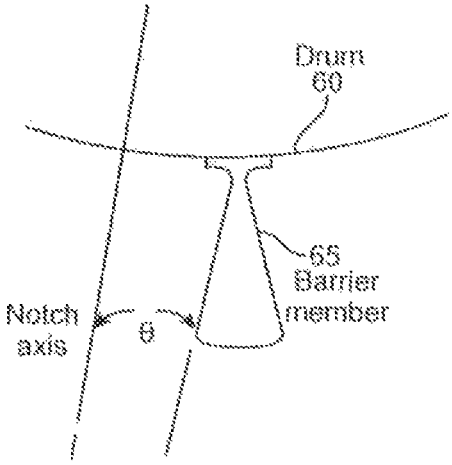
FIG. 13B illustrates an alternative embodiment of a device for braiding a plurality of filaments in a tubular braid that includes a plurality of barrier members forming an angle θ with respect to a radial axis of notch.
Figure 13C:
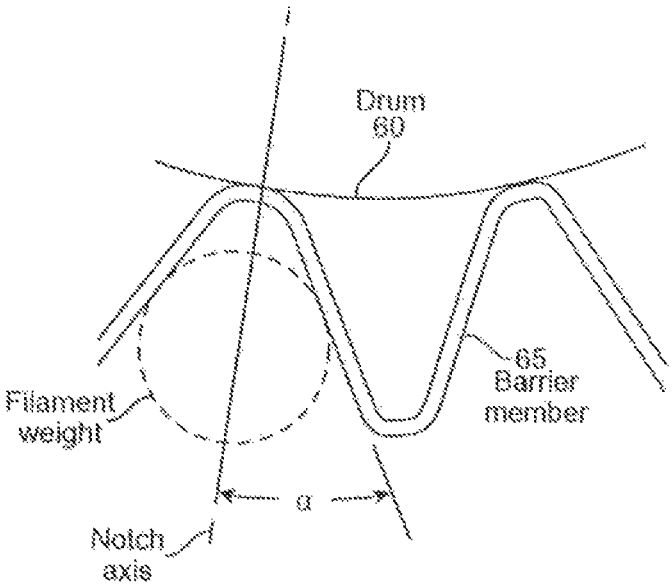
FIG. 13C illustrates an alternative embodiment of a device for braiding a plurality of filaments in a tubular braid that includes a plurality of barrier members forming a V-shaped notch.

In some embodiments, cylindrical drum 60 may comprise a plurality of barrier members 65 that define a plurality of notches 26 or holding spaces, as shown in FIG. 13. The barrier members 65 may be substantially perpendicular to the drum as shown in FIG. 13A. Alternatively, as depicted in FIG. 13B, the barrier members 65 may form an angle, θ with respect to a radial axis of notch. The angle θ may range from about 0° to about 25', alternatively from about 0° to about 20°, alternatively from about 0° to about 15°, alternatively from about 0° to about 10°, alternatively from about 0° to about 5°. In some embodiments, the barrier may form a V-shaped notch and an angle α, as shown in FIG. 13C. The angle α may range from about 30° to about 75°, alternatively from about 40° to about 60°, alternatively from about 45° to about 55°. The barrier members 65 may provide improved stability of weights or tensioning elements 6*a-x* when the drum is rotated. Improved stability may allow the braider to be operated at increased operating speeds.

Figure 14A:
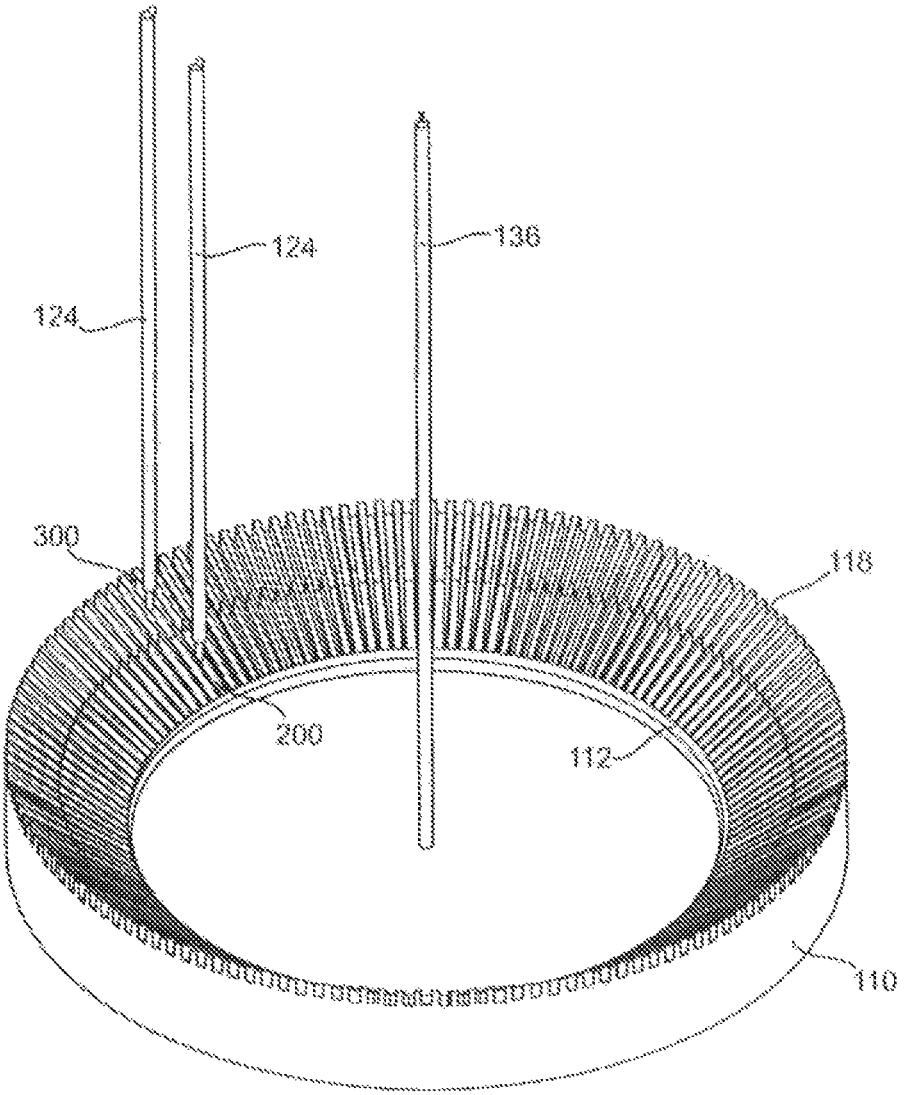
FIG. 14A illustrates an alternative embodiment of a device for braiding a plurality of filaments in a tubular braid according to the present invention.
Figure 14B:
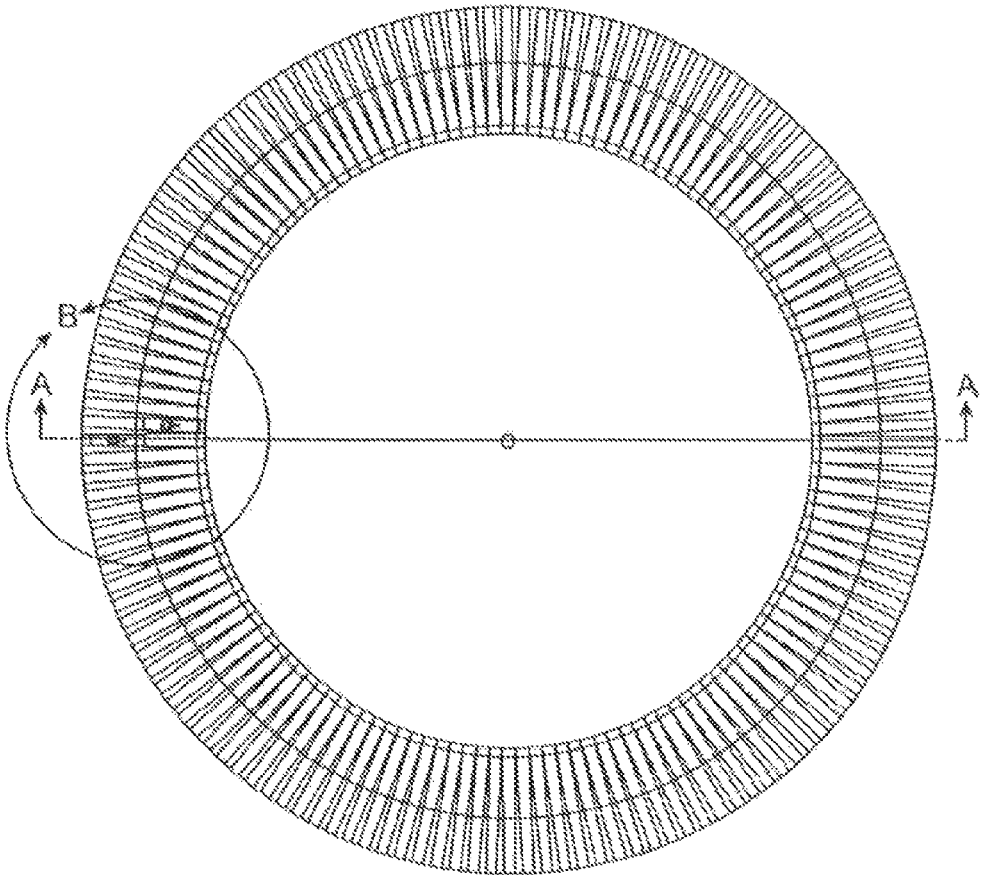
FIG. 14B illustrates top view of the device of FIG. 14A for braiding a plurality of filaments in a tubular braid according to the present invention.
Figure 14C:
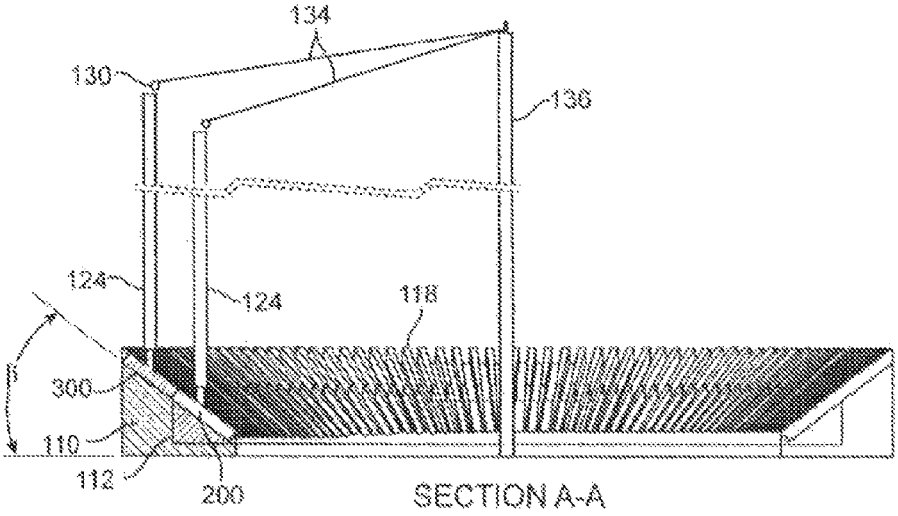
FIG. 14C illustrates a cross section of the device of FIG. 14A for braiding a plurality of filaments in a tubular braid according to the present invention.
Figure 14D:
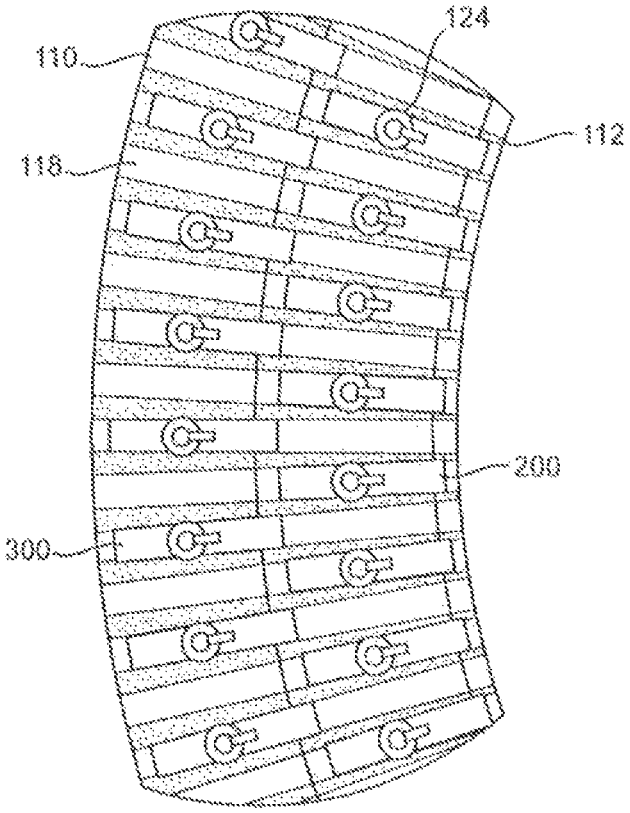
FIG. 14D illustrates a section of the device of FIG. 14A for braiding a plurality of filaments in a tubular braid according to the present invention.

In another embodiment, as depicted in FIGS. 14A-14D, the braiding mechanism comprises a stationary outer ring member 110 and a rotating inner ring member 112. Alternatively, the braiding mechanism may have a stationary inner ring and a rotating outer ring. Each of the ring members 110, 112 have a plurality slots 118 to accommodate a plurality of shuttle members 200, 300 that are each connected to a braiding slide and weight housing 124. Each of the shuttle members may slide between the slots in the inner 112 and outer 110 ring members when the slots are aligned. At the top end of the braid slide and weight housing 124, a filament (or wire) guide member (e.g., a pulley) 130 guides the filaments 134 emanating from the mandrel 136 down the slide so that the tensioning member (e.g. weight, not shown) at the distal end of the filament is contained within the slide housing 124 (see FIG. 14C). Two exemplary shuttle members 200, 300 and their attached braid slide and weight housings 124 are depicted in FIG. 14C. As seen in FIG. 14D, each of the aligned slots 118 contains one shuttle member 200, 300.

In some embodiments, the outer ring 110 may form an inclined or conical surface at an angle β. As shown in FIG. 14C, the angle β is formed between an axis of the outer ring and a horizontal axis that lies perpendicular to the axis of the mandrel 136. Thus, the slots in the inner and outer ring may be inclined at substantially the same angle β. This incline orients the filament guide members 130 such that those filaments guided by shuttles in the outer ring are above those filaments in the inner ring. This height difference facilitates crossing of the wires with less friction. In some embodiments, the angle β may range from about 10° to about 70°, alternatively from about 30° to about 50°.

In use, the shuttle members 200, 300 are moved in a radial direction (both inward and outward), alternating between slots in the outer ring 110 and inner ring 112, by an actuator such as a solenoid or other actuators known in the art. Magnets, pins, air pressure or other engagement means may be used to facilitate control of the shuttle members.

Figure 15A:
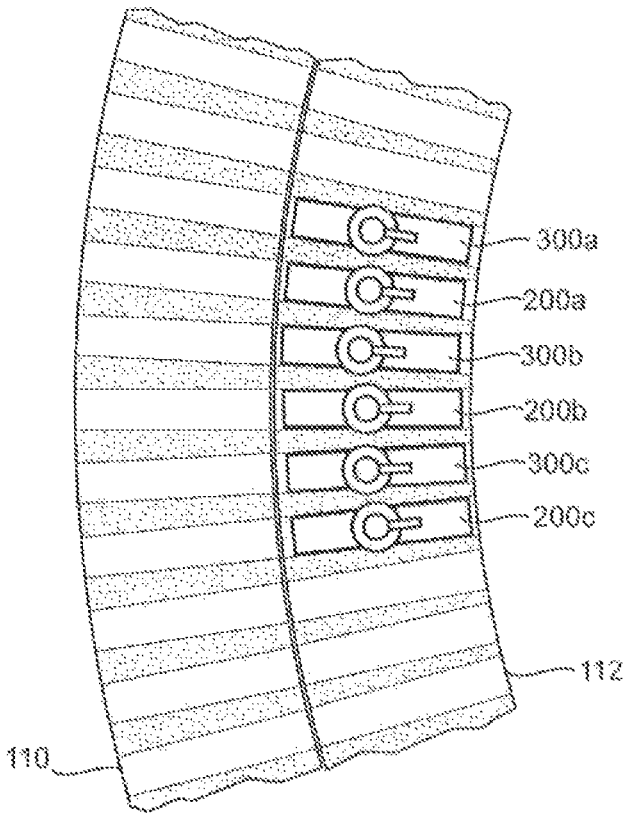
Figure 15B:
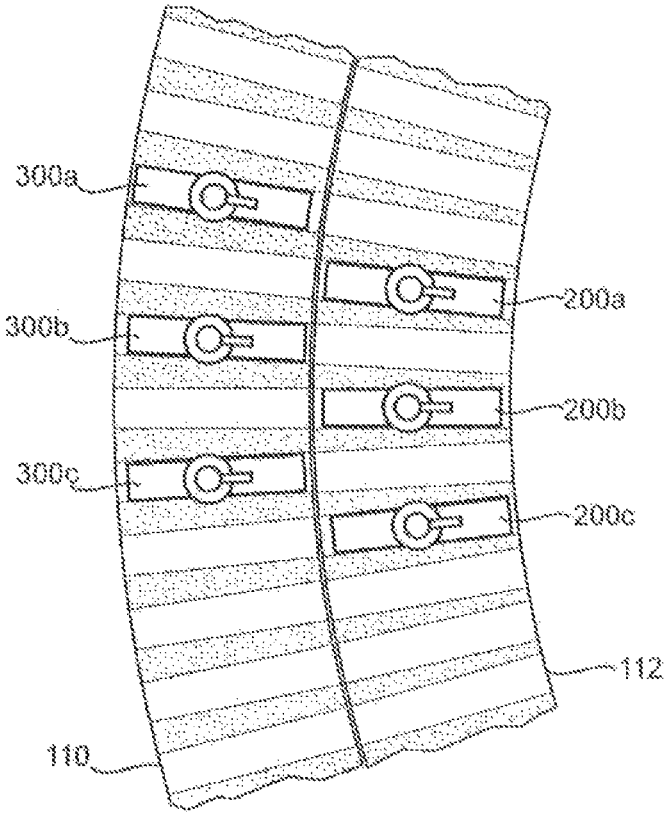
Figure 15C:
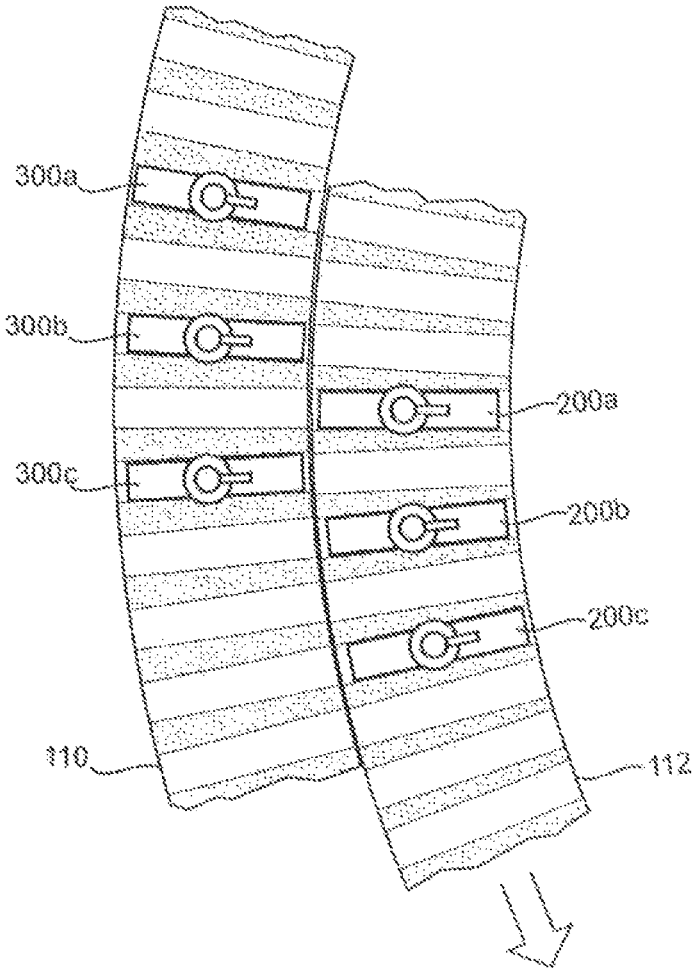
Figure 15D:
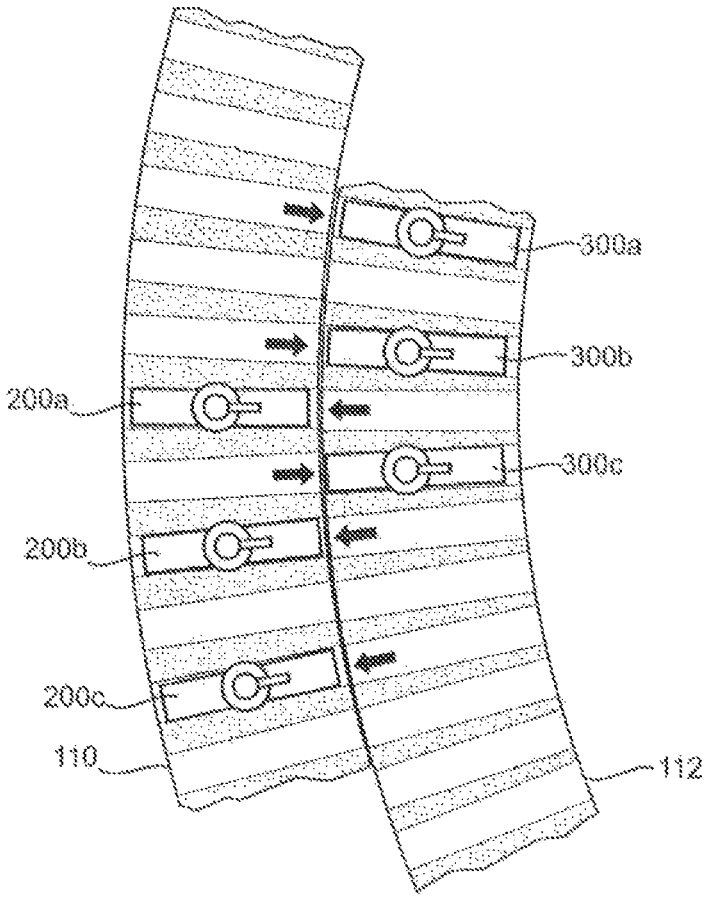
Figure 15E:
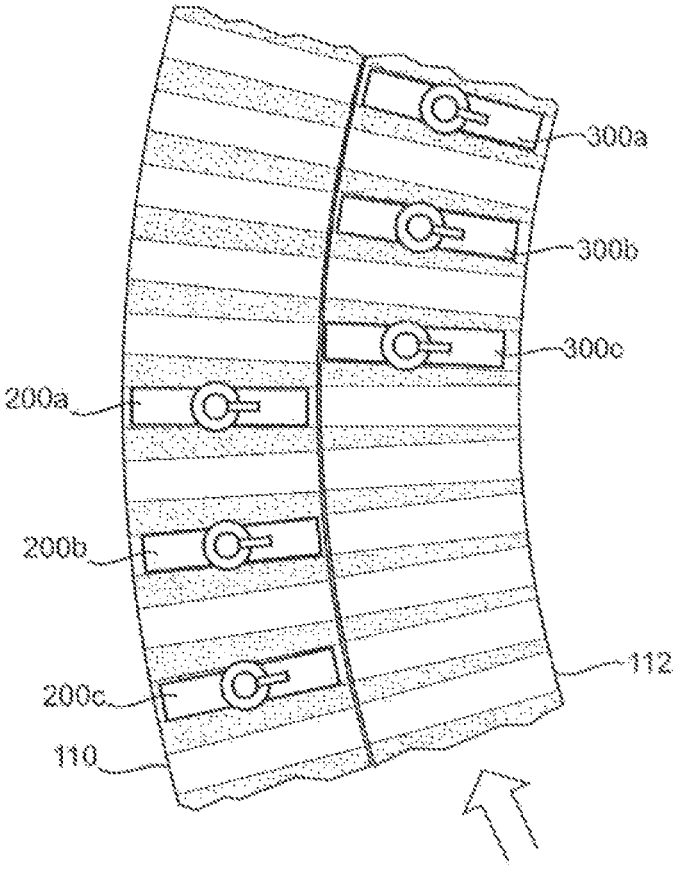
Figure 15F:
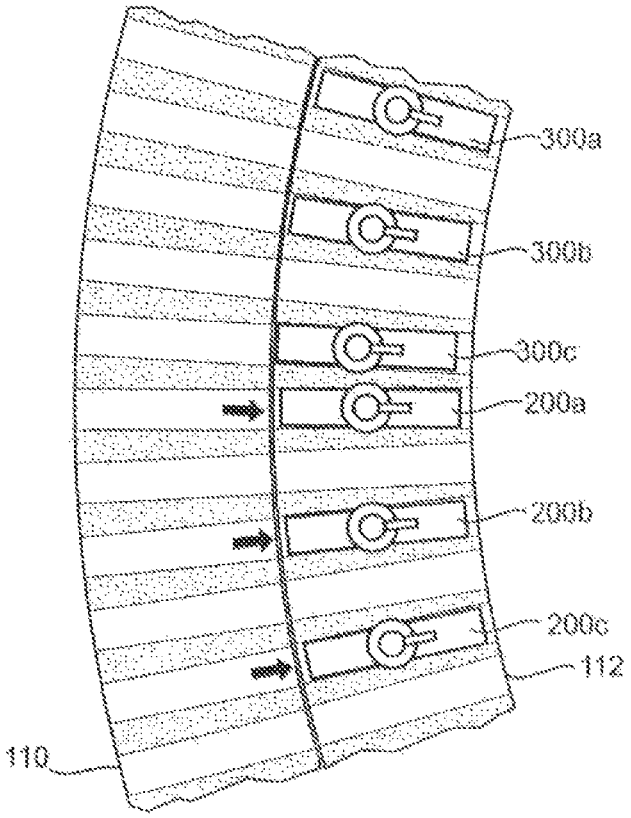

FIGS. 15A-F illustrate the movement of six exemplary shuttle members 200*a-c*, 300*a-c*. As seen in FIG. 15A, shuttle members are initially located in slots in the inner ring 112. A subset of shuttle members are then moved or translated to the outer ring 110. As seen in FIG. 15B, shuttle members 200*a-c* are still located in alternating slots (i.e., every other) in the inner ring 112, while shuttle members 300*a-c* are now located in alternating slots (i.e., every other) in the outer ring 110. One of the inner or outer rings is then rotated. As seen in FIG. 15C, inner ring 112 rotates in a first direction (e.g., counterclockwise), thereby translating shuttles 200*a-c* a certain distance d with respect to slots located in the stationary outer ring 110. In one embodiment, as seen in FIG. 15C, shuttles 200*a-c* located in the inner ring 112 are moved to slot positions a distance 2d away in the first direction (e.g., counterclockwise), where d is about the width of a slot. When the inner ring 112 is translated a distance 2d, the subset of the shuttles 300*a-c* housed in the slots in the inner ring along with the braiding filaments operably connected to the shuttles are also translated in an arcuate path for a distance to cross the subset of filaments under the other filaments. Next, as seen in FIG. 15D, shuttle members 200*a-c* in the inner ring are translated, slid, or moved upward to the aligned slots in the outer ring 110. Similarly, shuttle members 300*a-b* are translated, slid, or moved from the slot in the outer ring 110 to the aligned slot in the inner ring 112. As seen in FIG. 15E, inner ring 112 is then rotated in a second direction that is opposite from the first direction (e.g., clockwise), thereby translating shuttles 300*a-b* a certain distance d (e.g., 2d) with respect to slots located in the stationary outer ring lift. The sequence depicted in FIGS. 15B-E is then repeated to form the braid, with the inner ring 112 alternating directions of rotation. The machine moves the filaments in a gear tooth-like path, as depicted in FIG. 12. As a final step in forming the braid, all of the shuttles again are shifted into the same ring (inner or outer). As seen in FIG. 15F, shuttles 200*a-c* located in the outer ring 110 have been moved or translated into the corresponding aligned slots in the inner ring 112 and all of the shuttles 200*a-c*, 300*a-c* now lie in slots in the inner ring 112.

In alternative embodiments, the shuttle may be moved to a slot position at least about 2d away, alternatively at least about 3d away, alternatively at least about 4d away, alternatively at least about 5d away. Alternatively, the outer ring may be rotated in the clockwise and counterclockwise directions and the inner ring may be stationary.

Although the foregoing invention has, for the purposes of clarity and understanding, been described in some detail by way of illustration and example, it will be obvious that certain changes and modifications may be practiced which will still fall within the scope of the appended claims.

What is claimed is:

1. A braiding machine comprising:

a first annular member having an inner diameter and an inclined surface;

a second annular member that is concentric with the first annular member, the second annular member having an outer diameter, an inclined surface and a substantially circular region, the outer diameter of the second annular member being less than the inner diameter of the first annular member;

a mandrel extending perpendicular to and intersecting a horizontal plane defined by the substantially circular region of the second annular member substantially at the center of the circular region, the mandrel having a longitudinal axis;

a first plurality of tubular wire guides;

a first plurality of tubular wire guides slideably mounted on the first annular member with each tubular wire guide spaced a distance 2d from the next adjacent tubular wire guide of the first annular member;

a second plurality of tubular wire guides slideably mounted on the second annular member, the tubular wire guides being mounted around the circumference of the second annular member with each tubular wire guide spaced a distance 2d from the next adjacent tubular wire guide of the second annular member;

a plurality of wires extending from the mandrel, each wire received within one of the tubular wire guides;

wherein one of the first and second annular members rotates circumferentially relative to the other of the first and second annular members, the first plurality of tubular wire guides slides radially inward so as to align with the second annular member, and the second plurality of tubular wire guides slides radially outward so as to align with the first annular member; and wherein the inclined surfaces of the first and second annular members are inclined at a non-zero angle formed between an axis of the outer ring and a horizontal axis that lies perpendicular to the longitudinal axis of the mandrel.

2. The braiding machine of claim 1, wherein the non-zero angle is between about 10° and about 70°.

3. The braiding machine of claim 2, wherein the non-zero angle is between about 30° and about 50°.

4. The braiding machine of claim 2, wherein the first tubular wire guides are slideably mounted within circumferentially arrayed slots in the first annular member.

5. The braiding machine of claim 4, wherein the second tubular wire guides are slideably mounted within circumferentially arrayed slots in the second annular member.

6. The braiding machine of claim 5, wherein the slots of the first annular member are configured to align with the slots of the second annular member such that the first tubular guides are able to move from slots in the first annular member into empty slots in the second tubular member, and the second tubular guides are able to move from slots in the second annular member into empty slots in the first tubular member.

7. The braiding machine of claim 6, wherein each empty slot of the first annular member is spaced a distance d from an adjacent slot having a first tubular wire guide.

8. The braiding machine of claim 1, further comprising a plurality of weights associated with the plurality of wires.

9. The braiding machine of claim 8, wherein the plurality of weights is configured to be movably contained within the first plurality of tubular wire guides and the second plurality of tubular wire guides.

10. The braiding machine of claim 9, wherein the first plurality of tubular wires guides and the second plurality of tubular wire guides are associated with a plurality of guide members.

11. The braiding machine of claim 10, wherein the plurality of guide members comprises a plurality of pulleys.

12. The braiding machine of claim 1, wherein the first annular member rotates circumferentially relative to the second annular member.

13. The braiding machine of claim 1, wherein the second annular member rotates circumferentially relative to the first annular member.

14. The braiding machine of claim 1, wherein the substantially circular region of the second annular member comprises an opening.

15. The braiding machine of claim 1, wherein the first annular member is a ring.

16. The braiding machine of claim 1, wherein the second annular member is a ring.

17. A method of braiding, comprising the steps of:

providing a machine comprising:

a first annular member having an inner diameter and an inclined surface;

a second annular member that is concentric with the first annular member, the second annular member having an outer diameter, an inclined surface and a substantially circular region, the outer diameter of the second annular member being less than the inner diameter of the first annular member;

a mandrel extending perpendicular to and intersecting a horizontal plane defined by the substantially circular region of the second annular member substantially at the center of the circular region, the mandrel having a longitudinal axis, wherein the inclined surfaces of the first and second annular members are inclined at a non-zero angle formed between an axis of the outer ring and a horizontal axis that lies perpendicular to the longitudinal axis of the mandrel;

a first plurality of tubular wire guides slideably mounted on the first annular member with each tubular wire guide spaced a distance 2d from the next adjacent tubular wire guide of the first annular member;

a second plurality of tubular wire guides slideably mounted on the second annular member, the tubular wire guides being mounted around the circumference of the second annular member with each tubular wire guide spaced a distance 2d from the next adjacent tubular wire guide of the second annular member;

a plurality of wires extending from the mandrel, each wire received within one of the tubular wire guides;

rotating one of the first and second annular members circumferentially relative to the other of the first and second annular members;

sliding the first plurality of tubular wire guides radially inward such that the first plurality of tubular wire guides aligns with the second annular member; and sliding the second plurality of tubular wire guides radially outward such that the second plurality of tubular wire guides aligns with the first annular member.

18. The method of claim 17, further comprising the steps of:

rotating one of the first and second annular members circumferentially relative to the other of the first and second annular members;

sliding the second plurality of tubular wire guides radially inward such that the second plurality of tubular wire guides aligns with the second annular member; and sliding the first plurality of tubular wire guides radially outward such that the first plurality of tubular wire guides aligns with the first annular member.

19. The method of claim 17, wherein the non-zero angle is between about 10° and about 70°.

20. The method of claim 19, wherein the non-zero angle is between about 30° and about 50°.

21. The method of claim 17, wherein the machine further comprises:

a plurality of weights associated with the plurality of wires.

22. The method of claim 21, wherein the plurality of weights is configured to be moveably contained within the first plurality of tubular wire guides and the second plurality of tubular wire guides.

23. The method of claim 17, wherein the first plurality of tubular wire guides and the second plurality of tubular wire guides are associated with a plurality of guide members.

24. The method of claim 17, wherein the substantially circular region of the second annular member comprises an opening.

25. The method of claim 17, wherein the first annular member is a ring.

26. The method of claim 17, wherein the second annular member is a ring.

* * * * *